US007309383B2

(12) United States Patent
Beech, Jr. et al.

(10) Patent No.: US 7,309,383 B2
(45) Date of Patent: Dec. 18, 2007

(54) PROCESS FOR REMOVING SOLID PARTICLES FROM A GAS-SOLIDS FLOW

(75) Inventors: James H. Beech, Jr., Kingwood, TX (US); James R. Lattner, Seabrook, TX (US); Nicolas P. Coute, Houston, TX (US); Jeff S. Smith, Baytown, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 425 days.

(21) Appl. No.: 10/948,984

(22) Filed: Sep. 23, 2004

(65) Prior Publication Data

US 2006/0059870 A1 Mar. 23, 2006

(51) Int. Cl.
*B01D 50/00* (2006.01)
*B01D 53/34* (2006.01)

(52) U.S. Cl. ..... 95/268; 95/271; 95/288; 55/315; 55/345; 422/177; 585/639; 585/910; 585/911

(58) Field of Classification Search ..... 95/267, 95/268, 271, 288; 55/315, 343, 345; 422/168, 422/177; 585/639, 910, 911
See application file for complete search history.

(56) References Cited

U.S. PATENT DOCUMENTS

| | | | | |
|---|---|---|---|---|
| 2,934,494 | A * | 4/1960 | Kleiber | 208/161 |
| 3,615,256 | A | 10/1971 | Miller et al. | 23/288 |
| 3,817,872 | A | 6/1974 | Evans et al. | 252/417 |
| 4,904,281 | A | 2/1990 | Raterman | 55/1 |
| 4,935,568 | A | 6/1990 | Harandi et al. | 585/300 |
| 4,956,509 | A | 9/1990 | Harandi et al. | 585/300 |
| 5,055,177 | A | 10/1991 | Haddad et al. | 208/161 |
| 5,068,010 | A * | 11/1991 | Mundstock et al. | 202/99 |
| 5,104,519 | A | 4/1992 | Haddad et al. | 208/152 |
| 5,290,431 | A | 3/1994 | Cunningham | 208/164 |
| 5,372,707 | A | 12/1994 | Buchanan et al. | 208/161 |
| 6,023,005 | A | 2/2000 | Lattner et al. | 585/639 |
| 6,121,504 | A | 9/2000 | Kuechler et al. | 585/640 |
| 6,166,282 | A | 12/2000 | Miller | 585/638 |
| 6,673,133 | B2 | 1/2004 | Sechrist et al. | 55/348 |
| 6,870,072 | B2 * | 3/2005 | Lumgair et al. | 585/639 |
| 2002/0016522 | A1 | 2/2002 | Vaughn et al. | 585/640 |

FOREIGN PATENT DOCUMENTS

| | | |
|---|---|---|
| JP | 10279960 | 10/1998 |
| WO | WO 02/05952 | 1/2002 |

OTHER PUBLICATIONS

Thomas Derwent Abstract for JP 10279960, Oct. 20, 1998, entitled "*Coal Gasification Method Using Fluidised Bed Gasifier*".
API Derwent Abstract of G. Kissel, International Journal of Hydrocarbon Engineering, *Two-Stage Acrylonitrile Reactor Cyclone System*, 4(1), 53-54, 1998.

* cited by examiner

*Primary Examiner*—Robert A. Hopkins

(57) ABSTRACT

Catalyst losses are prevented in riser reactor systems by using a low inlet velocity for the first cyclone separator in each multi-stage cyclone separator in the reactor. Catalyst particles not separated from the product output flow in an oxygenate-to-olefin reactor are also recaptured by cooling the product output flow and passing the flow through an electrostatic precipitator.

8 Claims, 5 Drawing Sheets

PROCESS FOR REMOVING SOLID PARTICLES FROM A GAS-SOLIDS FLOW

FIELD OF THE INVENTION

This invention is directed to processes for reducing solids or catalyst losses from gas-solids reactors. In particular, this invention is directed to separating and recovering catalyst particles using cyclone separators.

BACKGROUND OF THE INVENTION

Fluid solids systems with vapor containing solids streams typically require the contained solids to be retained in certain equipment while the vapor product, essentially free of solids, is processed in downstream equipment. It is desirable in these systems that the solids be as completely removed as possible from the vapor and retained in the fluid solids portion of the process. High solids retention in the fluid solids portion of the process is particularly desirable in cases in which the solids may be expensive, may contaminate the vapor product or downstream vapor process handling systems, and increase the capital and operating costs of downstream particulate capture devices such as wet gas scrubbers, electrostatic precipitators, or filters. Therefore, improvements in high efficiency solids/vapor separation systems are of particular interest.

In reactor systems that use small particle catalysts, the loss of catalyst particles during operation means that additional catalyst has to be added during operation to make up for the catalyst loss. Particularly in cases where the cost of catalyst is substantially high, even marginal improvements in solid particle retention can lead to substantial reductions in operating costs.

U.S. Pat. No. 2,934,494 to Kleiber describes a process for recovering finely divided solids in a fluidized bed reactor using at least two cyclone separator stages. In Kleiber, the velocity in the second cyclone stage is at least 50% greater than the velocity in the first cyclone stage, and the velocities of the first cyclone stage range from 50 to 70 ft/sec. The process provided in Kleiber maintains a fines content in the catalyst inventory, commonly referred to as equilibrium catalyst or e-cat, of between 9-30% in the reactor.

What is needed is an improved process for removing solid particles in gas-solids reactors, particularly in reaction systems that use molecular sieve type catalysts. Especially desirable processes would include those that provide for a higher retention rate of solid particles, and those that have minimal or no impact on the efficiency of the reaction being carried out in the reactor. Such processes would also be advantageously carried out with little or no damage to the catalyst; in particular, with little to no physical damage, thereby reducing particle attrition during operation.

SUMMARY OF THE INVENTION

This invention provides improved processes for removing, separating and/or recovering solids particles from a gas-solids reaction system. In an embodiment, the invention is directed to a process that comprises flowing a gas-solids flow within a reactor into at least one initial separator. The initial separator, which can be either a cyclone or non-cyclonic separator, separates the gas-solids flow into a first portion and a second portion. In such an embodiment, the first portion has a density greater than the second portion. The second, lower density portion produced by the initial separator is then fed into one or more additional cyclone separators at an inlet velocity greater than or equal to the inlet velocity of the initial separator. Preferably, the gas-solids flow has an inlet velocity into the initial separator of 40 ft/sec or less.

In another embodiment, the invention comprises a process for removing solids from a gas-solids flow in a methanol to olefin reactor. Preferably, feedstock is passed through a fluidized bed of solid catalyst particles to form an olefin product flow. This olefin product flow is then separated into a higher density flow and a lower density flow. The lower density flow is cooled to a temperature between about 250° F. and about 800° F., preferably less than 500° F. The cooled lower density flow is then flowed through a precipitator or filter to remove solid particles from the flow, such as fines having a particle size of 44 microns or less. The lower density flow is then quenched to remove water from the flow.

In still another embodiment, the invention comprises a process for removing solids from a gas-solids flow in a methanol to olefin reactor. A reacted feedstock flow within the reactor is separated into a first portion and a second portion by flowing the feedstock into an initial separator at an inlet velocity of 40 ft/sec or less. In such an embodiment, the first portion has a density greater than the second portion. The second portion is then fed to one or more additional separators, at an inlet velocity greater than or equal to the inlet velocity of the initial separator. This creates a third flow and a fourth flow, with the third flow having a density greater than the fourth flow. The fourth flow is cooled to a temperature between about 250° F. and about 800° F., preferably between about 250° F. and about 500° F. The cooled fourth flow is then flowed through a precipitator or filter to remove solid particles from the flow.

BRIEF DESCRIPTION OF THE DRAWINGS

Various embodiments of the invention are also described in the accompanying drawings, wherein.

DETAILED DESCRIPTION OF THE INVENTION

I. Overview

Figure 1:
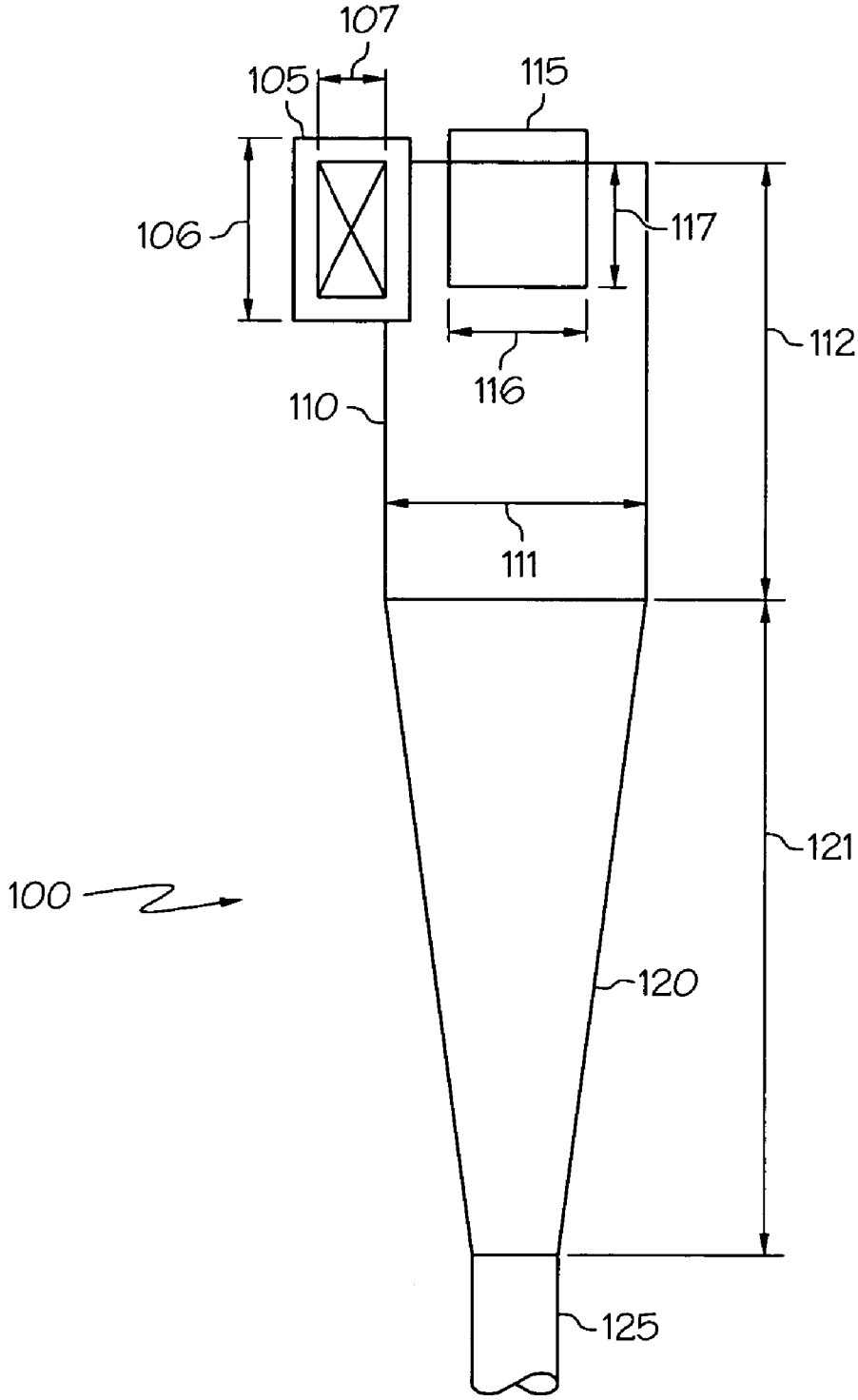
FIG. 1 depicts a simplified schematic of a cyclone separator according to an embodiment of the invention.

This invention provides a process having improved efficiency in removing solids particles from a gas-solids reaction system. In particular, the process of the invention provides improved solid particle recovery using an improved cyclone operation system.

The invention further provides processes for improving the separation of solids from a gas-solids flow, while reducing attrition of the solid particles. In one embodiment, this is achieved by controlling the velocities in separation devices used for separating the solid particles from the gas flow. For example, in an embodiment where the solid particles are separated using a series of cyclone separators, the first cyclone separator is operated at a low velocity. The velocity should be high enough to allow the cyclone to effectively separate larger particles from the flow stream while being low enough to minimize attrition of the particles. Additional cyclone separators, openly or closely coupled in series with the first cyclone, are each operated at a velocity equal to or greater than the velocity of the previous cyclone. This selection of velocities in the cyclones allows the majority of the solid particles to be removed from the gas flow at low velocity, where particle attrition is low.

In one embodiment of the invention, a majority of the solids particles removed from the gas flow are removed in a first cyclone. Preferably, the average diameter of the particles removed in the first reactor is larger than that of the particles removed in any subsequent cyclone. After removing the majority of the solids, the higher velocities of later cyclone separators in a series are more effective for removing the smaller solid particles in the gas flow. This overall solid particle process reduces the loss of catalyst particles from the reactor vessel due to less than complete separation of the catalyst particles from the output product flow. The process can be used to remove solid particles from the output product flow of a reactor, or to remove regenerated solid particles from a regenerator gas flow.

The process of this invention greatly reduces the attrition and breakage rate of particles within the cyclone system. In particular, the creation of "fines," or particles having an average diameter of less than about 44 microns, preferably less than 40 microns, and more preferably less than 35 microns, is minimized. By reducing or minimizing the creation of fines, the amount of solids lost from the reactor due to poor separation of small particles is minimized. Reducing the rate of fines creation, and thus particle loss, reduces the need to add additional catalyst to the reactor which lowers the cost of operation.

In one embodiment of the invention, the solids particles are separated from the gas flow using cyclone separators. Conventional cyclone separators can be used. Preferably, at least two cyclones are used in series.

Non-conventional cyclones can also be used in this invention. Such cyclones include cyclonic separators having a variety of geometries, such as various conical or cylindrical geometries that are susceptible to use in creating a cyclone for separation by density. Such separators preferably cause separation by a mechanism similar to a centrifuge. A flow is introduced into the cyclone with sufficient velocity to set up a swirling flow pattern in the separator. As the flow travels through the cyclone separator, higher density components of the flow, such as solid particles, are driven to the bottom of the cyclone and exit through the bottom. The lower density components, such as the gas phase components of a gas-solids flow, tend to be driven to the top of the device.

This invention may also be applied to non-cyclone separators that rely on solids impact for separation. In such devices, a first stage, is preferably operated at an impact velocity lower than successive downstream stages. Non limiting examples of non-cyclone separators include tee disengagers, plate disengagers, curved surface disengagers, and other similar devices.

The invention also includes the use of multistage cyclone separator systems. In one embodiment, multiple stages of cyclones are arranged in series and operated at high cyclone inlet velocities to achieve high solids capture efficiency. In a particular embodiment, a gas-solids flow is passed through a processing region. For example, the processing region can be a riser reactor or fluid bed reactor for performing a methanol-to-olefin conversion reaction, a catalytic cracking reaction, or the processing region can be a regenerator for removing coke that has accumulated on the solid catalyst particles. After passing the gas-solids flow through the processing region, at least a majority of the solids are removed from the gas-solids flow.

In one embodiment of the invention, the gas-solids flow is passed through at least one initial cyclone separator. The initial cyclone separators, each representing the first cyclone in a multi-stage cyclone, are operated at a low inlet velocity within the cyclone, such as 40 ft/sec or less. In alternative embodiments, the first cyclone is preferably operated at a velocity of not greater than 35 ft/sec, more preferably not greater than 30 ft/sec, or still more preferably not greater than 25 ft/sec. In still another embodiment, the first cyclone can be operated at a cyclone velocity of not greater than 20 ft/sec. By operating the first cyclone at a low input velocity, the majority of solids are separated out of the gas-solids flow without exposing the solids to a high rate of attrition. As a result, the attrition and breakage rate is maintained at a low level in the cyclone stage where the majority of particles are removed.

After passing through the initial cyclone(s), the gas portion of the output flow passes through one or more additional cyclone stages. The gas portion of the output flow of the one or more additional cyclones has a reduced solids content and reduced average solids particle diameters relative to any preceding stage.

In one embodiment, a plurality of cyclones in series is used, and at least one of the cyclones downstream of the initial cyclone has a higher inlet velocity relative to the initial cyclone. Preferably, each cyclone in series has an inlet velocity that is the same as or greater than the inlet velocity for each previous cyclone.

In another embodiment, a plurality of cyclones in series is used, and at least one of the cyclones downstream of the initial cyclone in the series has an inlet velocity of about 60 ft/sec or greater. Preferably at least one of the cyclones downstream of the initial cyclone in series has an inlet velocity of 70 ft/sec or greater, and more preferably 100 ft/sec or greater.

Each of the cyclones used in the cyclone system, preferably produce at least two output portions: a first, higher density (solids) portion and a second, lower density (gas) portion. The higher density (solids) portion of the output flow for each cyclone is preferably returned to join the solids in the reactor for use in further processing, such as through a cyclone dipleg. The lower density (gas) portion of the output of the last cyclone stage represents the product output flow. This product output flow is combined with the lower density outputs of any other multistage cyclone system for separation of the desired output product (e.g., olefin product or cracked hydrocarbon product) from the output flow.

In one embodiment of the invention, solids are sent to a reactor, such as an oxygenate to olefin reactor or an FCC reactor, and subsequently to a first cyclone. The solids are sent to the reactor at a rate that depends on a number of variables, including the type of catalyst and the flow rate of the feedstock. Preferably, the solid particles enter a multi-stage cyclone via an initial cyclone for separation of at least a majority of the solid particles from a gaseous portion of the reactant/product flow.

Depending on the type of reactor, the particle size used to characterize the fines content of the solids in the reactor system will vary. The fines within the reactor can be characterized, for example, by withdrawing a sample of the combined particle flows exiting from the diplegs of the cyclones in the reactor. In one embodiment, it is desirable to control the proportion of particles having an average diameter of 44 microns or less in relation to the total weight of particles in the reactor. In other embodiments, the particle size to be controlled can be 40 microns or less, or 30 microns or less, or 20 microns or less, or 10 microns or less. In various embodiments, when maintaining the fines content within the reactor, the desired weight of fines within the reactor can be 50% or less, 20% or less, 15% or less, 10% or less, 8% or less, 7% or less, 6% or less, 5% or less, 4% or less, 3% or less, or 2% or less, based on total weight of solids in the reactor. Note that the fines content within the reactor represents an equilibrium amount, based on both new creation of small particles through attrition, and loss of small particles that are not separated out of the product gas stream.

The gas-solids reactor system used according to this invention can be operated continuously for days, weeks, or even years. A convenient way to describe particle losses in a continuous system is as a weight percent loss relative to a total weight of particles flowing in the system. The loss of particles is preferably characterized relative to the total weight of particles passing through the initial separation stage. In an embodiment, 0.0005 wt % or less of the particles entering an initial separator are lost from the reactor. In another embodiments, the invention allows solid particles to be retained so that 0.0003 wt % or less of the particles entering an initial separator are lost from the reactor. In still another embodiment, 0.0002 wt % or less of the particles entering an initial separator are lost from the reactor.

In another embodiment, the invention provides improved separation of solids from a methanol to olefins reactor. Preferably, the product stream removed from the methanol to olefins reactor is cooled to a temperature below 400° C., but above the condensation point for the gas components of the product flow. Cooling the product stream allows the stream to pass through an electrostatic precipitator or filter, where an additional particles remaining in the product stream can be effectively removed. This process either reduces or completely avoids the need to conduct a solid-liquid separation to remove the solid particles from the output of the reactor. A portion of the solids removed by the electrostatic precipitator or filter can be returned to the reactor for further gas-solids reaction and thereby increase the e-cat fines content if desired. After the solids are removed, the remaining gas stream can be quenched to separate water in the gas stream from desired products.

II. Separators in a Riser Reactor

FIG. 1 schematically depicts a cyclone separator suitable for use in an embodiment of the invention. The cyclone 100 schematically shown in FIG. 1 includes a cyclone inlet 105, a cyclone barrel 110, an outlet pipe 115, and a cyclone cone 120 leading to a dipleg 125.

In various embodiments, one method for controlling the operation of a cyclone is by varying the geometry of the cyclone. By varying the geometry of cyclones within a series of cyclones, the velocity and other operational parameters of the cyclones can be selected or influenced.

In an embodiment, the cyclone barrel 110 can have a diameter 111 of from about 3.5 feet to about 9 feet. In various embodiments, the diameter of the cyclone barrel can be 4 feet or greater, 5 feet or greater, 6 feet or greater, 7 feet or greater, or 8 feet or greater. In corresponding embodiments, the diameter of the cyclone barrel can be 5 feet or less, 6 feet or less, 7 feet or less, 8 feet or less, or 9 feet or less. Preferably, for a cyclone separator which is the first in a series of cyclone separators (such as a primary cyclone receiving an output flow from a reactor), the diameter of the cyclone barrel is 7 feet or greater, or 8 feet or greater.

The height 112 of cyclone barrel 110 can be from about 7 feet to about 18 feet. In various embodiments, the height of the cyclone barrel can be 7 feet or greater, 8 feet or greater, 10 feet or greater, 12 feet or greater, 15 feet or greater, or 17 feet or greater. Alternatively, the height of the cyclone barrel can be 8 feet or less, 10 feet or less, 12 feet or less, 15 feet or less, 17 feet or less, or 18 feet or less. Preferably, for a cyclone separator which is the first in a series of cyclone separators, the height of the cyclone barrel is 15 feet or greater, or 17 feet or greater.

The height 106 of cyclone inlet 105 can be from about 2 feet to about 6 feet. In various embodiments, the height of the cyclone inlet can be 2 feet or greater, 3 feet or greater, 4 feet or greater, or 5 feet or greater. Alternatively, the height of the cyclone inlet can be 3 feet or less, 4 feet or less, 5 feet or less, or 6 feet or less. Preferably, for a cyclone separator which is the first in a series of cyclone separators, the height of the cyclone inlet is 5 feet or greater.

The width 107 of cyclone inlet 105 can be the same as the height 106 to produce a symmetric (square or circular) inlet, or the width can be from about 1 foot to about 4 feet. In various embodiments, the width of the cyclone inlet can be 1 foot or greater, 2 feet or greater, or 3 feet or greater. Alternatively the width of the cyclone inlet can be 2 feet or less, or 3 feet or less, or 4 feet or less. Preferably, for a cyclone separator which is the first in a series of cyclone separators, the width of the cyclone inlet is 2 feet or greater, or 3 feet or greater.

The diameter 116 of outlet pipe 115 can be from about 1 foot to about 4 feet. In various embodiments, the diameter of the outlet pipe can be 1 foot or greater, 1.5 feet or greater, 2 feet or greater, 2.5 feet or greater, 3 feet or greater, or 3.5 feet or greater. Alternatively, the diameter of the outlet pipe can be 1.5 feet or less, 2 feet or less, 2.5 feet or less, 3 feet or less, 3.5 feet or less, or 4 feet or less. Preferably, for a cyclone separator which is the first in a series of cyclone separators, the diameter of the outlet pipe is 3 feet or greater, or 3.5 feet or greater.

The length 117 that outlet pipe 115 extends into barrel 110 can be from about 2 feet to about 5 feet. In various embodiments, the length that the outlet pipe extends into the barrel can be 2 feet or greater, 3 feet or greater, or 4 feet or greater. Alternatively, the length that the outlet pipe extends into the barrel can be 3 feet or less, 4 feet or less, or 5 feet or less. Preferably, for a cyclone separator which is the first in a series of cyclone separators, the length that the outlet pipe extends into the barrel is 4 feet or greater.

The height 121 of cyclone cone 120 can be from about 10 feet to about 30 feet. In various embodiments, the height of the cyclone cone can be 10 feet or greater, 15 feet or greater, 20 feet or greater, or 25 feet or greater. Alternatively, the height of the cyclone cone can be 15 feet or less, 20 feet or less, 25 feet or less, or 30 feet or less. Preferably, for a cyclone separator which is the first in a series of cyclone separators, the height of the cyclone cone is 20 feet or greater, or 25 feet or greater.

The diameter of dipleg 125 can be from about 0.5 feet to about 3 feet. In various embodiments, the diameter of the dipleg can be 0.5 feet or greater, 1 foot or greater, 1.5 feet or greater, 2 feet or greater, or 2.5 feet or greater. Alternatively, the diameter can be 1 foot or less, 1.5 feet or less, 2 feet or less, 2.5 feet or less, or 3 feet or less. The diameter of the dipleg can be selected based on an expected solids flow rate through the dipleg. In an embodiment, the dipleg diameter is selected to so that the rate of solids flow through the dipleg is from 25 to 200 lb/ft$^2$*sec. Preferably, the dipleg diameter is selected to achieve a solids flow rate from 50 lb/ft$^2$*sec to 150 lb/ft$^2$*sec.

Figure 2:
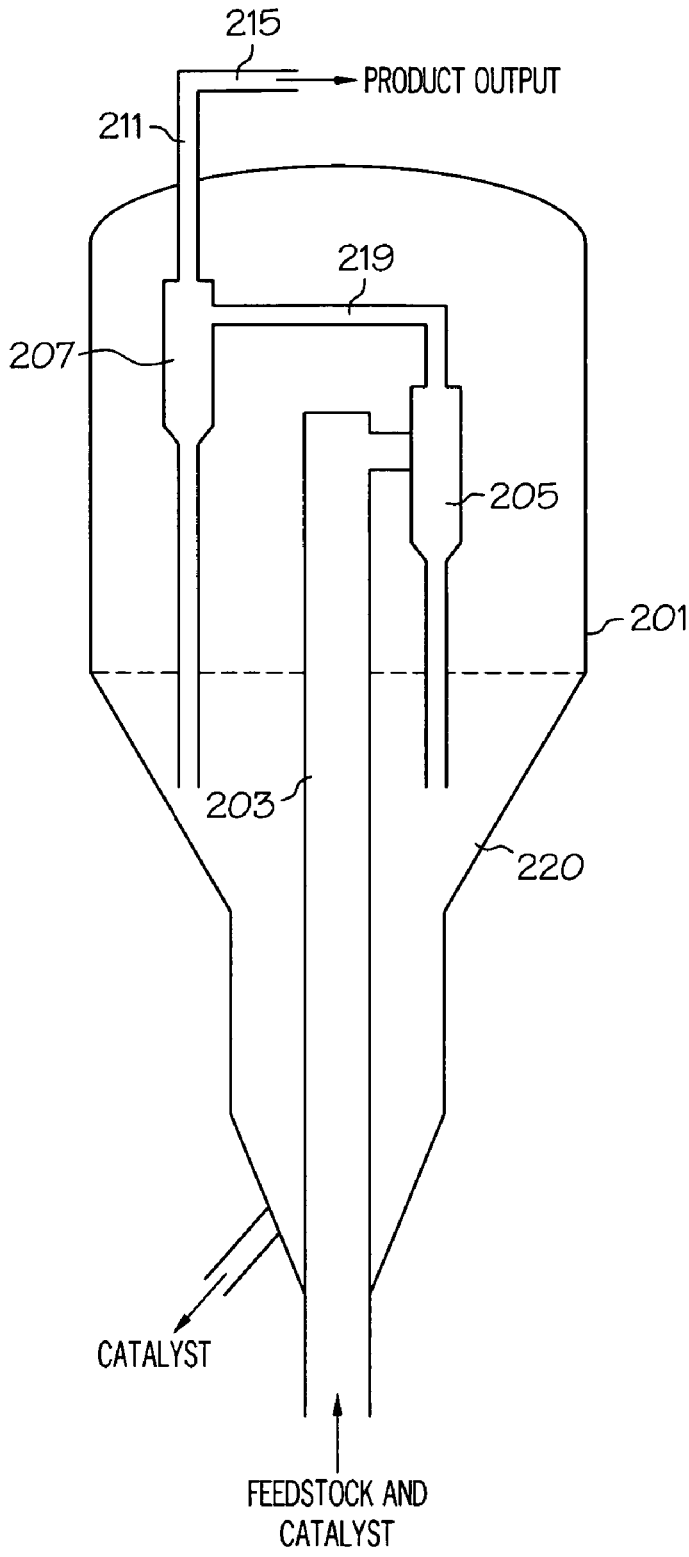
FIG. 2 depicts a simplified schematic of a riser reactor incorporating separators according to an embodiment of the invention.

FIG. 2 depicts a simplified representation of a fluid catalytic cracking riser reactor that makes use of the claimed invention. A vessel 201 surrounds the upper terminal end of a riser 203 to which are attached a primary cyclone 205, and secondary cyclone 207. The primary cyclone 205 is attached to the riser 203 by means of an enclosed conduit. The primary cyclone 205 in turn is connected to the secondary cyclone 207 by means of a conduit 219. Overhead gas from the secondary cyclone 207 exits the reactor vessel 201 by means of an overhead conduit 211. The gases which exit the reactor through the overhead conduit 211 then leave the reactor through reactor overhead port 215. Catalyst particles recovered by the cyclones 25 and 27 drop through cyclone diplegs into catalyst bed 220, indicated here as the volume below the dotted line. Although only one series connection of cyclones 205 and 207 are shown, more than one series connection and/or more than two stages of cyclones in series could be used.

In the embodiment depicted in FIG. 2, the cyclones are close coupled. In another embodiment, the cyclones are openly coupled, with no equivalent of overhead conduit 219 for direct travel of vapor from cyclone 205 to cyclone 207. In still other embodiments, any convenient coupling between cyclones can be used. Embodiments including an open coupling allow gases to enter the cyclone series without having to pass through the reaction zone in the riser.

Figure 3A:
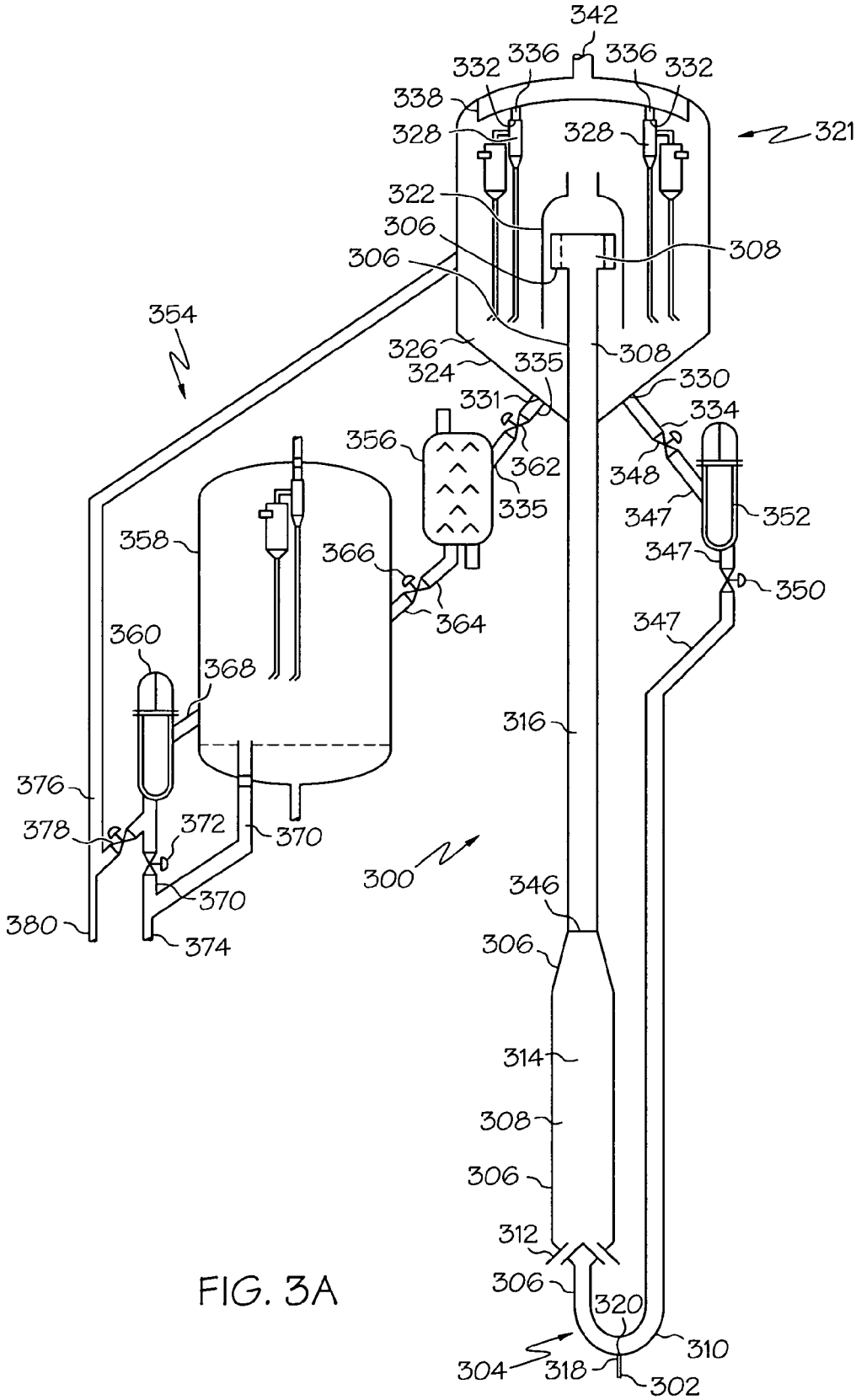
FIGS. 3A-3C depicts an embodiment of an oxygenate to olefin conversion reactor according to the invention that includes a regenerator as well as separation devices.
Figure 3B:
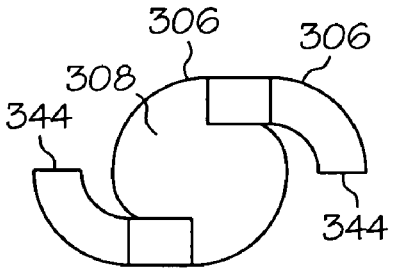
Figure 3C:
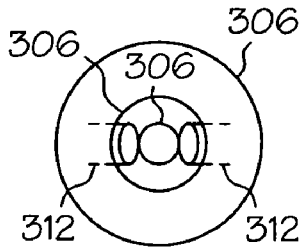

FIGS. 3A, 3B, and 3C depict another embodiment of the invention in which cyclones are incorporated into an oxygenate-to-olefin reactor system that includes a regenerator. FIG. 3A shows a sectional elevation of a hydrocarbon conversion apparatus 300. FIG. 3B presents a partial transverse section of the apparatus, looking down on FIG. 3A along the line indicated, focusing on elements associated with the upper portion of reactor shell 306, and omitting separation device 321. FIG. 3C also presents a partial transverse section of the apparatus, looking down on FIG. 3A along the line indicated that is lower than for FIG. 3B, focusing on the elements associated with the lower portion of reactor shell 306.

With regard to FIG. 3A, a broken line is shown in the reactor shell. It is to be understood, however, that the apparatus will use a reactor shell that is, in fact, solid without a break.

In the embodiment of FIGS. 3A-C, a small feedstock conduit 302, that would provide an at least partially gaseous feedstock to the apparatus, is openly joined to the bottom of a semi-circular section of a torus 304. In this embodiment, small feedstock conduit 302 is designed to provide only a small amount of feedstock to the apparatus relative to the total that would be provided to the apparatus, and also serves as fluidization gas conduit to provide a gas (in this case, the feedstock itself) to fluidize the catalyst that may reside around the semi-circular section of torus 304 when the apparatus is in use. This particular embodiment may allow for a reduction in the cost of a utility that may otherwise typically be used as a fluidization gas, e.g., steam or nitrogen.

The portion of the semi-circular section of a torus 304 directly above and to the left of small feedstock conduit 302 is a portion of reactor shell 306 that forms the totality of a reaction zone 308, in which a reaction among the feedstock and a solid, particulate catalyst would take place. The portion of the semi-circular section of a torus 304 directly to the right of small feedstock conduit 302 is a catalyst inlet conduit 310, that would provide a solid, particulate catalyst to reaction zone 308 (in this embodiment, the particular part of reaction zone 308 defined by the portion of the semi-circular section of a torus 304 directly above and to the left of small feedstock conduit 302). Two main feedstock conduits 312, that would provide a liquid or gaseous feedstock to the apparatus, pass through an opening in reactor shell 306 and protrude into reaction zone 308.

The reaction zone 308 is composed of a first reaction stage 314 and a second reaction stage 316, distinguished in that the former has a larger AED than the latter, and provided to allow feedstock, product and other gasses that may flow through the reaction zone 308 to have an increasing gas superficial velocity as the extent of reaction increases. The reactor shell 306, and hence reaction zone 308 formed thereby, is comprised of 8 contiguous, openly joined geometries, starting from the bottom and working upwards: a one quarter section of a torus; a short, right cylinder; a right frustum of a cone with the base at the top (whose volume must be discounted by the protruding main feedstock conduits 312); a longer right cylinder; another right frustum of a cone with the base at the bottom; yet another, longer right cylinder; and two straight rectangular ducts and two curved rectangular ducts. The short, straight and rectangular duct configuration is an example of a "ram's head" configuration.

A lowest feedstock inlet 318, through which feedstock would flow from small feedstock conduit 302 into first reaction stage 314, is defined as the open, cross-section surface, parallel to grade, formed at the open joint of small feedstock conduit 302 with reactor shell 306. In this embodiment, a catalyst inlet 320, through which a solid, particulate catalyst would flow from catalyst inlet conduit 310 into first reaction stage 314, is established as the open, minimum area, cross-section surface at the point where small feedstock conduit 302 and catalyst inlet conduit 310 join (in this instance, within the torus along a vertical plane perpendicular to the page). The point where small feedstock conduit 302 and catalyst inlet conduit 310 join is the first point the catalyst could be exposed to feedstock, and thus catalyst inlet 320 represents a portion of the boundary of first reaction stage 314.

FIG. 3A further shows a separation device 321 which is comprised of separation elements 322, 324, 326 and 328, catalyst exits 330 and 331, and product exits 332. The "ram's head" end of reactor shell 306 is in open communication with termination volume 326, formed by termination vessel shell 324. Located within termination volume 326 is a cylinder 322, open on both ends, surrounding the ram's head. In operation, the catalyst exiting the ram's head would strike the cylinder 322 at a tangent to its internal perimeter, and the combination of the ram's head configuration and cylinder 322 will act similarly to a cyclone separator, discussed previously. More conventional series cyclone separators 328 are provided as another separation element.

A first catalyst exit conduit 334, which would carry catalyst away from the separation device 321, is openly joined to termination vessel shell 324. A first catalyst exit 330, through which a catalyst may flow out of the termination volume 326 and into first catalyst exit conduit 334, is formed as the open surface area at the junction of termination vessel shell 324 and catalyst exit conduit 334. A second catalyst exit conduit 335, which would carry catalyst away from the separation device 321, is openly joined to termination vessel shell 324. A second catalyst exit 331, through which a catalyst may flow out of the termination volume 326 and into second catalyst exit conduit 335, is formed as the open surface area at the junction of termination vessel shell 324 and second catalyst exit conduit 335.

Product exit conduits 336, through which would carry a reaction product and possibly unconverted feedstock away from separation device 321,are openly joined to the top of series cyclone separators 328. Product exits 332, through which a reaction product and possibly unreacted feedstock would flow out of series cyclone separators 328 and into product exit conduits 336, are formed as the open surfaces at the junction of series cyclone separators 328 and product exit conduits 336. Product exit conduits 336 are openly joined to a plenum 338. A plenum volume 340 is formed within the boundaries of plenum 338 as joined to the top of termination vessel shell 324. The plenum 338 and plenum volume 340 are provided to collect reaction product and possibly unreacted feedstock exiting product exit conduits 336, and direct that material to a common, secondary product exit conduit 342, provided to convey reaction product and possibly unreacted feedstock away from the apparatus.

A second material transit 344, through which a solid, particulate catalyst, a conversion product and possibly unreacted feedstock may flow out of second reaction stage 316 and into separation device 321, is determined as the open, cross-section surface formed at the open ends of the ram's head at the top of reactor shell 306 that is in open communication with termination vessel volume 326. The volume of reaction zone 308, which is the sum of the volumes of first reactions stage 314 and second reaction stage 316, is established by geometric calculations according to the prevalent dimensions moving along and within the walls of the apparatus between the lowest feedstock inlet 318 and the second material transits 344. It should noted that in determining the total volume of reaction zone 308, the volume within feedstock conduits 312 are omitted. This is because in operation, the flow of feedstock out of the feedstock conduits 312 will be of sufficient force to prevent catalyst from entering the volume within the feedstock conduits 312, and a reaction could not take place there.

The embodiment of FIGS. 3A-C further includes a catalyst circulation conduit 347, through which a solid, particulate catalyst may flow, that has a first end, first catalyst exit conduit 334, and a second end, catalyst inlet conduit 310. Catalyst circulation conduit 347 is provided to enable fluid communication between first catalyst exit 330 and catalyst inlet 320. In this embodiment, there are three other elements included in the path of catalyst that would travel from first catalyst exit 330 to catalyst inlet 320. The first is a first flow control device 348, provided to control the rate of flow of catalyst leaving termination volume 326 via catalyst exit 330 and entering first catalyst cooler 352. The second is a second flow control device 350, provided to control the rate of flow of catalyst leaving first catalyst cooler 352 and entering first reaction stage 314 via catalyst inlet 320. The third is a first catalyst cooler 352, provided to remove heat from catalyst that would travel from first catalyst exit 330 to catalyst inlet 320.

Also included in the embodiment of FIGS. 3A-C is an embodiment further including an optional, associated catalyst regeneration apparatus 354 in fluid communication with hydrocarbon reactor apparatus 300. The catalyst regeneration apparatus 354 comprises a catalyst stripper 356, a catalyst regenerator 358, and a second catalyst cooler 360.

A second catalyst exit conduit 335 shown in FIG. 3A further provides fluid communication of catalyst from separation device 321 via second catalyst exit 331 to a catalyst stripper 356. Second exit catalyst exit conduit 335 is openly joined to a place near the top of catalyst stripper 356, and has located in its length a first regenerator flow control device 362, provided to control the rate of flow of catalyst from separation device 321 to catalyst stripper 356. Catalyst stripper 356 is provided to remove at least a portion of volatile or entrained combustible materials from a catalyst in a stripping vapor stream that will exit through a conduit openly joined near the top of the catalyst stripper 356. That stripping vapor will be provided through a conduit openly joined near the bottom of catalyst stripper 356, and contact the catalyst that is passing downward, typically using mass transfer enhancing devices known to those skilled in the art, such as packing or trays. The catalyst will then exit the catalyst stripper 356 through a third catalyst conduit 364 openly joined near the bottom of the catalyst stripper 356. Third catalyst conduit 364 provides for fluid communication of catalyst from the catalyst stripper 356 to catalyst regenerator 358, and has located in its length a second regenerator flow control device 366, provided to control the rate of flow of catalyst from catalyst stripper 356 to catalyst regenerator 358.

The catalyst regenerator 358 is provided to restore reactive activity to a solid, particulate catalyst that may have been lost during a hydrocarbon conversion reaction in hydrocarbon conversion apparatus 300. Catalyst regenerator 358 is openly joined to a fourth catalyst conduit 368, to provide fluid communication of catalyst from catalyst regenerator 358 to a second catalyst cooler 360. Second catalyst cooler 360 is provided to remove heat from and reduce the temperature of catalyst from catalyst regenerator 358. A fifth catalyst conduit 370 provides fluid communication of cooled catalyst from catalyst cooler 360 back to catalyst regenerator 358, and has located in its length a third regenerator flow control device 372, provided to control the rate of flow of catalyst from catalyst cooler 360 to catalyst regenerator 358. Openly joined to fifth catalyst conduit 370 is a lift gas conduit 374, that provides a lift gas to transport catalyst up fifth catalyst conduit 370 and back into catalyst regenerator 358. A sixth catalyst conduit 376 splits off from fifth catalyst conduit 370 and is openly termination vessel 324. Sixth catalyst conduit 376 provides fluid communication of catalyst from catalyst cooler 360 to termination volume 326, and has located in its length a fourth regenerator flow control device 378, provided to control the rate of flow of catalyst from catalyst cooler 360 to termination volume 326. Openly joined to sixth catalyst conduit 376 is a lift gas conduit 380, that provides a lift gas to transport catalyst up sixth catalyst conduit 376 and into termination volume 326.

Figure 4:
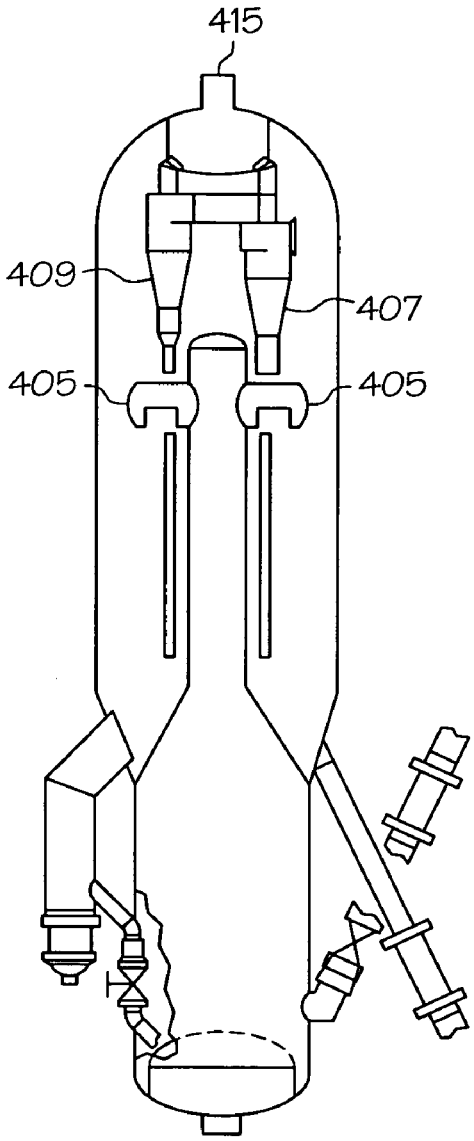
FIG. 4 depicts another embodiment of a riser reactor incorporating separation devices according to the invention.

FIG. 4 depicts another riser reactor suitable for performing the method of this invention. In this embodiment, the riser reactor preferably employs both tee disengagers and cyclone separators for particle separation. In other embodiments, the reactor can include tee, plate, or curved surface disengager separators, or non-cyclonic separation devices.

In FIG. 4, tee separators 405 perform the initial particle separation for a gas-solids stream exiting from riser 403 into reactor vessel 401. After this initial separation, the gas-solids stream passes through additional cyclones 407 and 409 before exiting the reactor through overhead port 415. In an embodiment, the inlet velocity of the gas solids flow into the tee separators 405 is at a lower velocity for performing an initial separation while minimizing damage to solid particles in the gas-solids flow. After this initial separation, the cyclones 407 and 409 can be operated at a higher velocity.

III. Types of Reaction Systems

The separation processes of this invention are useful in any reaction system that involves the use of catalyst that comprises any molecular sieve material susceptible to attrition. Non-limiting examples of such reaction systems include reaction systems selected from the group consisting of catalytic cracking reaction systems, transalkylation reaction systems, isomerization reaction systems, catalytic dewaxing systems, alkylation reaction systems, hydrocracking reaction systems, systems for converting paraffins to olefins, systems for converting paraffins to aromatics, systems for converting olefins to gasoline, systems for converting olefins to distillate, systems for converting olefins to lubes, systems for converting alcohols to olefins, disproportionation reaction systems, systems for converting aromatics to higher aromatics, systems for adsorbing aromatics, systems for converting oxygenates (e.g., alcohols) to olefins, systems for converting oxygenates (e.g., alcohols) to aromatics or gasoline, systems for oligomerizing olefins, and systems for converting unsaturated hydrocarbons to aldehydes. More specificially, such examples include:

A) The catalytic cracking of a naphtha feed to produce light olefins. Typical reaction conditions include from about 500° C. to about 750° C., pressures of subatmospheric or atmospheric, generally ranging up to about 10 atmospheres (gauge) and residence time (time of contact of feed and/or product with catalyst) from about 10 milliseconds to about 10 seconds;

B) The catalytic cracking of high molecular weight hydrocarbons to lower weight hydrocarbons. Typical reaction conditions for catalytic cracking include temperatures of from about 400° C. to about 700° C., pressures of from about 0.1 atmosphere (bar) to about 30 atmospheres, and weight hourly space velocities of from about 0.1 $hr^{-1}$ to about 100 $hr^{-1}$;

C) The transalkylation of aromatic hydrocarbons in the presence of polyalkylaromatic hydrocarbons. Typical reaction conditions include a temperature of from about 200° C. to about 500° C., a pressure of from about atmospheric to about 200 atmospheres, a weight hourly space velocity of from about 1 $hr^{-1}$ to about 100 $hr^{-1}$, and an aromatic hydrocarbon/polyalkylaromatic hydrocarbon mole ratio of from about 1/1 to about 16/1;

D) The isomerization of aromatic (e.g., xylene) feedstock components. Typical reaction conditions for such include a temperature of from about 230° C. to about 510° C., a pressure of from about 0.5 atmospheres to about 50 atmospheres, a weight hourly space velocity of from about 0.1 $hr^{-1}$ to about 200 $hr^{-1}$, and a hydrogen/hydrocarbon mole ratio of from about 0 to about 100/1;

E) The catalytic dewaxing of hydrocarbons by selectively removing straight chain paraffins. The reaction conditions are dependent in large measure on the feed used and upon the desired pour point. Typical reaction conditions include a temperature between about 200° C. and 450° C., a pressure of up to 3,000 psig and a liquid hourly space velocity from 0.1 $hr^{-1}$ to 20 $hr^{-1}$.

F) The alkylation of aromatic hydrocarbons, e.g., benzene and alkylbenzenes, in the presence of an alkylating agent, e.g., olefins, formaldehyde, alkyl halides and alcohols having 1 to about 20 carbon atoms. Typical reaction conditions include a temperature of from about 100° C. to about 500° C., a pressure of from about atmospheric to about 200 atmospheres, a weight hourly space velocity of from about 1 $hr^{-1}$ to about 100 $hr^{-1}$, and an aromatic hydrocarbon/alkylating agent mole ratio of from about 1/1 to about 20/1;

G) The alkylation of aromatic hydrocarbons, e.g., benzene, with long chain olefins, e.g., $C_{14}$ olefin. Typical reaction conditions include a temperature of from about 50° C. to about 200° C., a pressure of from about atmospheric to about 200 atmospheres, a weight hourly space velocity of from about 2 $hr^{-1}$ to about 2000 $hr^{-1}$, and an aromatic hydrocarbon/olefin mole ratio of from about 1/1 to about 20/1. The resulting products from the reaction are long chain alkyl aromatics, which when subsequently sulfonated have particular application as synthetic detergents;

H) The alkylation of aromatic hydrocarbons with light olefins to provide short chain alkyl aromatic compounds, e.g., the alkylation of benzene with propylene to provide cumene. Typical reaction conditions include a temperature of from about 10° C. to about 200° C., a pressure of from about 1 to about 30 atmospheres, and an aromatic hydrocarbon weight hourly space velocity (WHSV) of from 1 $hr^{-1}$ to about 50 $hr^{-1}$;

I) The hydrocracking of heavy petroleum feedstocks, cyclic stocks, and other hydrocrack charge stocks. The catalyst will contain an effective amount of at least one hydrogenation component;

J) The alkylation of a reformate containing substantial quantities of benzene and toluene with fuel gas containing short chain olefins (e.g., ethylene and propylene) to produce mono- and dialkylates. Preferred reaction conditions include temperatures from about 100° C. to about 250° C., a pressure of from about 100 psig to about 800 psig, a WHSV-olefin from about 0.4 $hr^{-1}$ to about 0.8 $hr^{-1}$, a WHSV-reformate of from about 1 $hr^{-1}$ to about 2 $hr^{-1}$ and, optionally, a gas recycle from about 1.5 to about 2.5 vol/vol fuel gas feed;

K) The alkylation of aromatic hydrocarbons, e.g., benzene, toluene, xylene, and naphthalene, with long chain olefins, e.g., $C_{14}$ olefin, to produce alkylated aromatic lube base stocks. Typical reaction conditions include temperatures from about 100° C. to about 400° C. and pressures from about 50 psig to 450 psig;

L) The alkylation of phenols with olefins or equivalent alcohols to provide long chain alkyl phenols. Typical reaction conditions include temperatures from about 100° C. to about 250° C., pressures from about 1 to 300 psig and total WHSV of from about 2 $hr^{-1}$ to about 10 $hr^{-1}$;

M) The conversion of light paraffins to olefins and/or aromatics. Typical reaction conditions include temperatures from about 425° C. to about 760° C. and pressures from about 10 psig to about 2000 psig;

N) The conversion of light olefins to gasoline, distillate and lube range hydrocarbons. Typical reaction conditions include temperatures of from about 175° C. to about 375° C., and a pressure of from about 100 psig to about 2000 psig;

O) Two-stage hydrocracking for upgrading hydrocarbon streams having initial boiling points above about 200° C. to premium distillate and gasoline boiling range products or as feed to further fuels or chemicals processing steps. Either stage of the two-stage system can contain catalyst, which contains molecular sieve that is susceptible to loss of catalytic activity due to contact with water molecules. Typical reaction conditions include temperatures of from about 315° C. to about 455° C., pressures of from about 400 to about 2500 psig, hydrogen circulation of from about 1000 SCF/bbl to about 10,000 SCF/bbl and a liquid hourly space velocity (LHSV) of from about 0.1 $hr^{-1}$ to 10 $hr^{-1}$;

P) A combination hydrocracking/dewaxing process in the presence of a catalyst that contains molecular sieve that is susceptible to loss of catalytic activity due to contact with water molecules. The catalyst generally further comprises a hydrogenation component. Optionally included in the catalyst is zeolite molecular sieve such as zeolite Beta. Typical reaction conditions include temperatures from about 350° C. to about 400° C., pressures from about 1400 psig to about 1500 psig, LHSVs from about 0.4 $hr^{-1}$ to about 0.6 $hr^{-1}$ and a hydrogen circulation from about 3000 to about 5000 SCF/bbl;

Q) The reaction of alcohols with olefins to provide mixed ethers, e.g., the reaction of methanol with isobutene and/or isopentene to provide methyl-t-butyl ether (MTBE) and/or t-amyl methyl ether (TAME). Typical conversion conditions include temperatures from about 20° C. to about 200° C., pressures from 2 to about 200 atm, WHSV (gram-olefin per hour gram-zeolite) from about 0.1 $hr^{-1}$ to about 200 $hr^{-1}$ and an alcohol to olefin molar feed ratio from about 0.1/1 to about 5/1;

R) The disproportionation of aromatics, e.g., the disproportionation toluene to make benzene and paraxylene. Typical reaction conditions include a temperature of from about 200° C. to about 760° C., a pressure of from about atmospheric to about 60 atmosphere (bar), and a WHSV of from about 0.1 $hr^{-1}$ to about 30 $hr^{-1}$;

S) The conversion of naphtha (e.g., $C_6$-$C_{10}$) and similar mixtures to highly aromatic mixtures. Thus, normal and slightly branched chained hydrocarbons, preferably having a boiling range above about 40° C., and less than about 200° C., can be converted to products having a substantially higher octane aromatics content by contacting the hydrocarbon feed with a molecular sieve catalyst at a temperature of from about 400° C. to 600° C., preferably from about 480° C. to about 550° C., at pressures of from atmospheric to 40 bar, and liquid hourly space velocities (LHSV) of from 0.1 $hr^{-1}$ to 15 $hr^{-1}$;

T) The adsorption of alkyl aromatic compounds for the purpose of separating various isomers of the compounds;

U) The conversion of oxygenates, e.g., alcohols, such as methanol, or ethers, such as dimethylether, or mixtures thereof to hydrocarbons including olefins and aromatics with reaction conditions including temperatures of from about 275° C. to about 600° C., pressures of from about 0.5 atmosphere to about 50 atmospheres, and a liquid hourly space velocity of from about 0.1 $hr^{-1}$ to about 100 $h^{-1}$;

V) The oligomerization of straight and branched chain olefins having from about 2 to about 5 carbon atoms. The oligomers which are the products of the process are medium to heavy olefins which are useful for both fuels, i.e., gasoline or a gasoline blending stock, and chemicals. The oligomerization process is generally carried out by contacting the olefin feedstock in a gaseous state phase with a molecular sieve catalyst at a temperature in the range of from about 250° C. to about 800° C., a LHSV of from about 0.2 $hr^{-1}$ to about 50 $hr^{-1}$, and a hydrocarbon partial pressure of from about 0.1 to about 50 atmospheres. Temperatures below about 250° C. may be used to oligomerize the feedstock when the feedstock is in the liquid phase when contacting the coated zeolite catalyst. Thus, when the olefin feedstock contacts the catalyst in the liquid phase, temperatures of from about 10° C. to about 250° C. may be used;

W) The conversion of $C_2$ unsaturated hydrocarbons (ethylene and/or acetylene) to aliphatic $C_{6-12}$ aldehydes and converting said aldehydes to the corresponding $C_{6-12}$ alcohols, acids, or esters.

In general, reactor conditions include a temperature of from about 100° C. to about 760° C., a pressure of from about 0.1 atmosphere (bar) to about 200 atmospheres (bar), a weight hourly space velocity of from about 0.08 $hr^{-1}$ to about 2,000 $hr^{-1}$.

The separation processes of this invention are particularly suited to large, commercial scale reaction systems. For example, the separation processes of this invention are particularly suited to reaction systems that require a catalyst loading of at least about 1,000 kg of catalyst, based on total amount of catalyst located throughout the reaction system. In particular, the separation processes of this invention are particularly suited to reaction systems that require a catalyst loading of at least about 10,000 kg of catalyst, more particularly a catalyst loading of at least about 100,000 kg of catalyst, and most particularly a catalyst loading of at least about 250,000 kg of catalyst, based on total amount of catalyst located throughout the reaction system.

IV. Oxygenate to Olefin Reactions

An example of a reaction system that benefits from this invention is an oxygenate-to-olefin process. Conventionally, oxygenate-to-olefin processes are carried out in a fluidized bed, fast fluidized bed, or riser reactor configuration where a fluid (gas) flow of a feedstock is passed through a bed of solid catalyst particles. More generally, the processes of this invention are applicable to gas-solids reaction systems where the solids are separated from the gas flow at some point during the reaction process, including systems where the gas is inert. The examples below describe an oxygenate to olefin reaction system that can be improved using the separation process of the invention.

Oxygenates used in this invention include one or more organic compound(s) containing at least one oxygen atom. In the most preferred embodiment of the process of invention, the oxygenate in the feedstock is one or more alcohol(s), preferably aliphatic alcohol(s) where the aliphatic moiety of the alcohol(s) has from 1 to 20 carbon atoms, preferably from 1 to 10 carbon atoms, and most preferably from 1 to 4 carbon atoms. The alcohols useful as feedstock in the process of the invention include lower straight and branched chain aliphatic alcohols and their unsaturated counterparts. Non-limiting examples of oxygenates include methanol, ethanol, n-propanol, isopropanol, methyl ethyl ether, dimethyl ether, diethyl ether, di-isopropyl ether, formaldehyde, dimethyl carbonate, dimethyl ketone, acetic acid, and mixtures thereof. In the most preferred embodiment, the feedstock is selected from one or more of methanol, ethanol, dimethyl ether, diethyl ether or a combination thereof, more preferably methanol and dimethyl ether, and most preferably methanol.

The feedstock, in one embodiment, contains one or more diluent(s), typically used to reduce the concentration of the feedstock, and are generally non-reactive to the feedstock or molecular sieve catalyst composition. Non-limiting examples of diluents include helium, argon, nitrogen, carbon monoxide, carbon dioxide, water, essentially non-reactive paraffins (especially alkanes such as methane, ethane, and propane), essentially non-reactive aromatic compounds, and mixtures thereof. The most preferred diluents are water and nitrogen, with water being particularly preferred.

The diluent is either added directly to a feedstock entering into a reactor or added directly into a reactor, or added with a molecular sieve catalyst composition. In one embodiment, the amount of diluent in the feedstock is in the range of from about 1 to about 99 mole percent based on the total number of moles of the feedstock and diluent, preferably from about 1 to 80 mole percent, more preferably from about 5 to about 50, most preferably from about 5 to about 25. In another embodiment, other hydrocarbons are added to a feedstock either directly or indirectly, and include olefin(s), paraffin(s), aromatic(s) (see for example U.S. Pat. No. 4,677,242, addition of aromatics) or mixtures thereof, preferably propylene, butylene, pentylene, and other hydrocarbons having 4 or more carbon atoms, or mixtures thereof.

In a conventional oxygenate to olefin reaction, a feed containing an oxygenate is contacted in a reaction zone of a reactor apparatus with a molecular sieve catalyst at process conditions effective to produce light olefins, i.e., an effective temperature, pressure, WHSV (weight hour space velocity) and, optionally, an effective amount of diluent, correlated to produce light olefins. Usually, the oxygenate feed is contacted with the catalyst when the oxygenate is in a vapor phase. Alternately, the process may be carried out in a liquid or a mixed vapor/liquid phase. When the process is carried out in a liquid phase or a mixed vapor/liquid phase, different conversions and selectivities of feed-to-product may result depending upon the catalyst and reaction conditions. As used herein, the term reactor includes not only commercial scale reactors but also pilot sized reactor units and lab bench scale reactor units.

V. Reactors Systems and Flow Conditions

The conversion of oxygenates to produce light olefins may be carried out in a variety of large scale catalytic reactors, including, but not limited to, fluid bed reactors and concurrent riser reactors as described in Fluidization Engineering, D. Kunii and O. Levenspiel, Robert E. Krieger Publishing Co. NY, 1977, incorporated in its entirety herein by reference. Additionally, countercurrent free fall reactors may be used in the conversion process. See, for example, U.S. Pat. No. 4,068,136 and Fluidization and Fluid-Particle Systems, pages 48-59, F. A. Zenz and D. F. Othmer, Reinhold Publishing Corp., NY 1960, the descriptions of which are expressly incorporated herein by reference.

In one embodiment of this invention, the gas and solid particles are flowed through the gas-solids reactor system at a weight hourly space velocity (WHSV) of from about 1 $hr^{-1}$ to about 5,000 $hr^{-1}$, preferably from about 5 $hr^{-1}$ to about 3,000 $hr^{-1}$, more preferably from about 10 $hr^{-1}$ to about 1,500 $hr^{-1}$, and most preferably from about 20 $hr^{-1}$ to about 1,000 $hr^{-1}$. In one preferred embodiment, the WHSV is greater than 25 $hr^{-1}$, and up to about 500 $hr^{-1}$. In this invention, WHSV is defined as the total weight per hour of the gas flowing between reactor walls divided by the total weight of the solids flowing between the same segment of reactor walls. The WHSV is maintained at a level sufficient to keep the catalyst composition in a fluidized state within a reactor.

In another embodiment of the invention, the gas and solid particles are flowed through the gas-solids reactor system at a gas superficial velocity (GSV) at least 1 meter per second (m/sec), preferably greater than 2 m/sec, more preferably greater than 3 m/sec, and most preferably greater than 4 m/sec. The GSV should be sufficient to maintaining the solids in a fluidized state, particularly in a fast fluidized state.

In yet another embodiment of the invention, the solids particles and gas are flowed through the gas-solids reactor at a solids to gas mass ratio of about 5:1 to about 75:1. Preferably, the solids particles and gas are flowed through the gas-solids reactor at a solids to gas mass ratio of about 8:1 to about 50:1, more preferably from about 10:1 to about 40:1.

In one practical embodiment, the process is conducted as a fluidized bed process or high velocity fluidized bed process utilizing a reactor system, a regeneration system and a recovery system. In such a process the reactor system conveniently includes a fluid bed reactor system having a first reaction region consisting of various fast fluid or dense fluid beds in series or parallel and a second reaction region within at least one disengaging vessel, typically comprising one or more cyclones. In one embodiment, the fast fluid or dense fluid beds and disengaging vessel are contained within a single reactor vessel. Fresh feedstock, preferably containing one or more oxygenates, optionally with one or more diluent(s), is fed to the one or more fast fluid or dense fluid beds reactor(s) into which a molecular sieve catalyst composition or coked version thereof is introduced. In one embodiment, prior to being introduced to the reactor(s), the molecular sieve catalyst composition or coked version thereof is contacted with a liquid and/or vapor, preferably water and methanol, and a gas, for example, an inert gas such as nitrogen.

In an embodiment, the amount of fresh feedstock fed as a liquid and/or a vapor to the reactor system is in the range of from 0.1 weight percent to about 99.9 weight percent, such as from about 1 weight percent to about 99 weight percent, more typically from about 5 weight percent to about 95 weight percent based on the total weight of the feedstock including any diluent contained therein. The liquid and vapor feedstocks may be the same composition, or may contain varying proportions of the same or different feedstocks with the same or different diluents.

The process of this invention can be conducted over a wide range of temperatures, such as in the range of from about 200° C. to about 1000° C., for example from about 250° C. to about 800° C., including from about 250° C. to about 750 ° C., conveniently from about 300° C. to about 650° C., typically from about 350° C. to about 600° C. and particularly from about 350° C. to about 550° C.

Similarly, the process of this invention can be conducted over a wide range of pressures including autogenous pressure. Typically the partial pressure of the feedstock exclusive of any diluent therein employed in the process is in the range of from about 0.1 kPaa to about 5 MPaa, such as from about 5 kpaa to about 1 MPaa, and conveniently from about 20 kpaa to about 500 kPaa.

The solids particles and gas are flowed through the gas-solids reactor at a solids to gas mass ratio of about 0.5:1 to about 75:1. Preferably, the solids particles and gas are flowed through the gas-solids reactor at a solids to gas mass ratio of about 8:1 to about 50:1, more preferably from about 10:1 to about 40:1.

During the conversion of a hydrocarbon feedstock, preferably a feedstock containing one or more oxygenates, the amount of olefin(s) produced based on the total weight of hydrocarbon produced is greater than 50 weight percent, typically greater than 60 weight percent, such as greater than 70 weight percent, and preferably greater than 75 weight percent. In one embodiment, the amount of ethylene and/or propylene produced based on the total weight of hydrocarbon product produced is greater than 65 weight percent, such as greater than 70 weight percent, for example greater than 75 weight percent, and preferably greater than 78 weight percent. Typically, the amount ethylene produced in weight percent based on the total weight of hydrocarbon product produced, is greater than 30 weight percent, such as greater than 35 weight percent, for example greater than 40 weight percent. In addition, the amount of propylene produced in weight percent based on the total weight of hydrocarbon product produced is greater than 20 weight percent, such as greater than 25 weight percent, for example greater than 30 weight percent, and preferably greater than 35 weight percent.

The feedstock entering the reactor system is preferably converted, partially or fully, in the first reactor region into a gaseous effluent that enters the disengaging vessel along with the coked catalyst composition. In one embodiment, the disengaging vessel includes a stripping zone, typically in a lower portion of the disengaging vessel. In the stripping zone the coked catalyst composition is contacted with a gas, preferably one or a combination of steam, methane, carbon dioxide, carbon monoxide, hydrogen, or an inert gas such as argon, preferably steam, to recover adsorbed hydrocarbons from the coked catalyst composition that is then introduced to the regeneration system.

The coked catalyst composition is withdrawn from the disengaging vessel and introduced to the regeneration system. The regeneration system comprises a regenerator where the coked catalyst composition is contacted with a regeneration medium, preferably a gas containing oxygen, under conventional regeneration conditions of temperature, pressure and residence time.

Non-limiting examples of suitable regeneration media include one or more of oxygen, $O_3$, $SO_3$, $N_2O$, NO, $NO_2$, $N_2O_5$, air, air diluted with nitrogen or carbon dioxide, oxygen and water (U.S. Pat. No. 6,245,703), carbon monoxide and/or hydrogen. Suitable regeneration conditions are those capable of burning coke from the coked catalyst composition, preferably to a level less than 0.5 weight percent based on the total weight of the coked molecular sieve catalyst composition entering the regeneration system. For example, the regeneration temperature may be in the range of from about 200° C. to about 1500° C., such as from about 300° C. to about 1000° C., for example from about 450° C. to about 750° C., and conveniently from about 550° C. to 700° C. The regeneration pressure may be in the range of from about 15 psia (103 kpaa) to about 500 psia (3448 kpaa), such as from about 20 psia (138 kPaa) to about 250 psia (1724 kpaa), including from about 25 psia (172kPaa) to about 150 psia (1034 kpaa), and conveniently from about 30 psia (207 kPaa) to about 60 psia (414 kPaa).

The residence time of the catalyst composition in the regenerator may be in the range of from about one minute to several hours, such as from about one minute to 100 minutes. The amount of oxygen in the regeneration flue gas (i.e., gas which leaves the regenerator) may be in the range of from about 0.01 mole percent to about 5 mole percent based on the total volume of the gas. The amount of oxygen in the gas used to regenerate the coked catalyst (i.e., fresh or feed gas) is typically at least about 15 mole percent, preferably at least about 20 mole percent, and more preferably from about 20 mole percent to about 30 mole percent, based on total amount of regeneration gas fed to the regenerator.

The burning of coke in the regeneration step is an exothermic reaction, and in an embodiment, the temperature within the regeneration system is controlled by various techniques in the art including feeding a cooled gas to the regenerator vessel, operated either in a batch, continuous, or semi-continuous mode, or a combination thereof. A preferred technique involves withdrawing the regenerated catalyst composition from the regeneration system and passing it through a catalyst cooler to form a cooled regenerated catalyst composition. The catalyst cooler, in an embodiment, is a heat exchanger that is located either internal or external to the regeneration system. Other methods for operating a regeneration system are in disclosed U.S. Pat. No. 6,290,916 (controlling moisture), which is herein fully incorporated by reference.

The regenerated catalyst composition withdrawn from the regeneration system, preferably from the catalyst cooler, is combined with a fresh molecular sieve catalyst composition and/or re-circulated molecular sieve catalyst composition and/or feedstock and/or fresh gas or liquids, and returned to the reactor(s). In one embodiment, the regenerated catalyst composition withdrawn from the regeneration system is returned to the reactor(s) directly, preferably after passing through a catalyst cooler. A carrier, such as an inert gas, feedstock vapor, steam or the like, may be used, semi-continuously or continuously, to facilitate the introduction of the regenerated catalyst composition to the reactor system, preferably to the one or more reactor(s).

By controlling the flow of the regenerated catalyst composition or cooled regenerated catalyst composition from the regeneration system to the reactor system, the optimum level of coke on the molecular sieve catalyst composition entering the reactor is maintained. There are many techniques for controlling the flow of a catalyst composition described in Michael Louge, Experimental Techniques, Circulating Fluidized Beds, Grace, Avidan and Knowlton, eds., Blackie, 1997 (336-337), which is herein incorporated by reference.

Coke levels on the catalyst composition are measured by withdrawing the catalyst composition from the conversion process and determining its carbon content. Typical levels of coke on the molecular sieve catalyst composition, after regeneration, are in the range of from 0.01 weight percent to about 15 weight percent, such as from about 0.1 weight percent to about 10 weight percent, for example from about 0.2 weight percent to about 5 weight percent, and conveniently from about 0.3 weight percent to about 2 weight percent based on the weight of the molecular sieve.

The gaseous effluent is withdrawn from the disengaging system and is passed through a recovery system. There are many well known recovery systems, techniques and sequences that are useful in separating olefin(s) and purifying olefin(s) from the gaseous effluent. Recovery systems generally comprise one or more or a combination of various separation, fractionation and/or distillation towers, columns, splitters, or trains, reaction systems such as ethylbenzene manufacture (U.S. Pat. No. 5,476,978) and other derivative processes such as aldehydes, ketones and ester manufacture (U.S. Pat. No. 5,675,041), and other associated equipment, for example various condensers, heat exchangers, refrigeration systems or chill trains, compressors, knock-out drums or pots, pumps, and the like.

Non-limiting examples of these towers, columns, splitters or trains used alone or in combination include one or more of a demethanizer, preferably a high temperature demethanizer, a dethanizer, a depropanizer, a wash tower often referred to as a caustic wash tower and/or quench tower, absorbers, adsorbers, membranes, ethylene (C2) splitter, propylene (C3) splitter and butene (C4) splitter.

Generally accompanying most recovery systems is the production, generation or accumulation of additional products, by-products and/or contaminants along with the preferred prime products. The preferred prime products, the light olefins, such as ethylene and propylene, are typically purified for use in derivative manufacturing processes such as polymerization processes. Therefore, in the most preferred embodiment of the recovery system, the recovery system also includes a purification system. For example, the light olefin(s) produced particularly in a MTO process are passed through a purification system that removes low levels of by-products or contaminants.

Typically, in converting one or more oxygenates to olefin(s) having 2 or 3 carbon atoms, a minor amount hydrocarbons, particularly olefin(s), having 4 or more carbon atoms is also produced. The amount of $C_4$+ hydrocarbons is normally less than 20 weight percent, such as less than 10 weight percent, for example less than 5 weight percent, and particularly less than 2 weight percent, based on the total weight of the effluent gas withdrawn from the process, excluding water. Typically, therefore the recovery system may include one or more reaction systems for converting the $C_4$+ impurities to useful products.

VI. Description of Solid Particles

This invention reduces the attrition of catalyst particles used in a gas-solids reaction. In this invention, attrition resistance, or catalyst hardness, is measured using an Attrition Rate Index (ARI). The ARI is used over other measurement methods, since many other methods are not sufficient to measure very highly attrition resistant molecular sieve catalysts such as those made according to this invention.

The ARI methodology is similar to the conventional Davison Index method. The smaller the ARI, the more resistant to attrition, hence the harder, is the catalyst. The ARI is measured by adding 6.0±0.1 g of catalyst having a particles size ranging from 53 to 125 microns to a hardened steel attrition cup. Approximately 23,700 scc/min of nitrogen gas is bubbled through a water-containing bubbler to humidify the nitrogen. The wet nitrogen passes through the attrition cup, and exits the attrition apparatus through a porous fiber thimble. The flowing nitrogen removes the finer particles, with the larger particles being retained in the cup. The porous fiber thimble separates the fine catalyst particles from the nitrogen that exits through the thimble. The fine particles remaining in the thimble represent catalyst that has broken apart through attrition.

The nitrogen flow passing through the attrition cup is maintained for 1 hour. The fines collected in the thimble are removed from the unit. A new thimble is then installed. The catalyst left in the attrition unit is attrited for an additional 3 hours, under the same gas flow and moisture levels. The fines collected in the thimble are recovered. The collection of fine catalyst particles separated by the thimble after the first hour are weighed. The amount in grams of fine particles divided by the original amount of catalyst charged to the attrition cup expressed on per hour basis is the ARI, in wt %/hr.

$$ARI=C/(B+C)/D\times 100\%$$

wherein

B=weight of catalyst left in the cup after the attrition test

C=weight of collected fine catalyst particles after the first hour of attrition treatment; and D=duration of treatment in hours after the first hour attrition treatment.

In an embodiment, the catalyst particles used in this invention desirably have an ARI of not greater than about 1 wt %/hr. Preferably the catalyst particles have an ARI of not greater than about 0.7 wt %/hr, more preferably not greater than about 0.3 wt %/hr.

In another embodiment, the catalyst particles used in this invention comprise a calcined molecular sieve catalyst containing catalyst particles having an ARI of not greater than about 1 wt %/hr, preferably of not greater than about 0.7 wt %/hr, more preferably of not greater than about 0.3 wt %/hr.

The ARI index is suitable for characterizing particles with a relatively high attrition resistance. Other particles may be easier to characterize using the Davison index. The Davison index, obtained by the procedure outlined in U.S. Pat. No. 3,650,988 is also used to measure the resistance to attrition. A catalyst that possesses a low Davison index will last longer than a catalyst that has a high Davison index. The Davison index is a measure of the percent of 0-20 micron particles formed by attrition from 20+ micron particles under test conditions. It is found by subtracting the percent 0-20 micron particles present in the original sample from the percent 0-20 micron particles found in the attrited sample. Then, dividing by the original percent 20+ fraction times 100 gives percent 0-20 micron particles made under test conditions. To calculate the index:

$$\text{Davison index}=100\times(A-B)/C=\%\ \text{0-20 micron particles formed during attrition test}$$

wherein

A=% 0-20 micron particles found in sample after 5 hours under test conditions

B=% 0-20 micron particles found in original sample

C=% 20+micron particles remaining in original sample after removal of 0-20 micron fraction To determine the Davison index, a 7 gram sample is screened to remove particles in the 0 to 20 micron size range. The 20+ micron sample is then subjected to a 5 hour test in a standard Roller Particle Size Analyzer using a 0.07 inch jet and 1 inch I.D. U-tube. An air flow rate of 9 liters per minute is used.

In an embodiment, the catalyst particles used in this invention have a Davison index of 25 or less, preferably 15 or less, and more preferably 10 or less.

Catalyst particles for use in a gas-solids reaction can be synthesized by a variety of methods. In an embodiment, catalyst particles are synthesized by combining a first dried molecular sieve catalyst with water to make a water-catalyst composition, making a slurry from the water-catalyst composition, and drying the slurry to produce a second dried molecular sieve catalyst. The method particularly provides for the re-manufacturing, recycling or re-working of dried or substantially dried, or partially dried molecular sieve catalysts to yield catalyst particles with properties that are acceptable to the user or manufacturer. Such properties are usually observed after the dried molecular sieve catalyst is calcined. These properties include acceptable particle size, particle size distribution, particle density, and particle hardness.

The catalysts of this invention can include any of a variety of molecular sieve components. The components include zeolites or non-zeolites, preferably non-zeolites. In one embodiment, the molecular sieves are small pore non-zeolite molecular sieves having an average pore size of less than about 5 angstroms, preferably an average pore size ranging from about 3 to 5 angstroms, more preferably from 3.5 to 4.2 angstroms. These pore sizes are typical of molecular sieves having 8 membered rings.

Conventional crystalline aluminosilicate zeolites having catalytic activity are desirable molecular sieves that can be used in making the catalyst of this invention. Examples of such zeolite materials are described in U.S. Pat. Nos. 3,660,274 and 3,944,482, both of which are incorporated herein by reference. Non-limiting examples of zeolites which can be employed in the practice of this invention, include both natural and synthetic zeolites. These zeolites include zeolites of the structural types included in the *Atlas of Zeolite Framework Types*, edited by Ch. Baerlocher, W. M. Meier, D. H. Olson, Fifth Revised edition, Elsevier, Amsterdam, 2001, the descriptions of which are incorporated herein by reference.

Zeolites typically have silica-to-alumina ($SiO_2/Al_2O_3$) mole ratios of at least about 2, and have uniform pore diameters from about 3 to 15 Angstroms. They also generally contain alkali metal cations, such as sodium and/or potassium and/or alkaline earth metal cations, such as magnesium and/or calcium. In order to increase the catalytic activity of the zeolite, it may be desirable to decrease the alkali metal content of the crystalline zeolite to less than about 5 wt. %, preferably less than about 1 wt. %, and more preferably less than about 0.5 wt. %. The alkali metal content reduction, as is known in the art, may be conducted by exchange with one or more cations selected from the Groups IIB through VIII of the Periodic Table of Elements (the Periodic Table of Elements referred to herein is given in *Handbook of Chemistry and Physics*, published by the Chemical Rubber Publishing Company, Cleveland, Ohio, 45th Edition, 1964 or 73rd Edition, 1992), as well as with hydronium ions or basic adducts of hydronium ions, e.g., $NH_4^+$, capable of conversion to a hydrogen cation upon calcination. Desired cations include rare earth cations, calcium, magnesium, hydrogen and mixtures thereof. Ion-exchange methods are well known in the art and are described, for example, in U.S. Pat. Nos. 3,140,249; 3,142,251 and 1,423,353, the teachings of which are hereby incorporated by reference.

In another embodiment, the catalyst particles which are flowed through the gas-solids reactor system of this invention are molecular sieve catalysts, such as a conventional molecular sieve. Examples include zeolite as well as non-zeolite molecular sieves, and are of the large, medium or small pore type. Non-limiting examples of these molecular sieves are the small pore molecular sieves, AEI, AFT, APC, ATN, ATT, ATV, AWW, BIK, CAS, CHA, CHI, DAC, DDR, EDI, ERI, GOO, KFI, LEV, LOV, LTA, MON, PAU, PHI, RHO, ROG, THO, and substituted forms thereof; the medium pore molecular sieves, AFO, AEL, EUO, HEU, FER, MEL, MFI, MTW, MTT, TON, and substituted forms thereof; and the large pore molecular sieves, EMT, FAU, and substituted forms thereof. Other molecular sieves include ANA, BEA, CFI, CLO, DON, GIS, LTL, MER, MOR, MWW and SOD. Non-limiting examples of the preferred molecular sieves, particularly for converting an oxygenate containing feedstock into olefin(s), include AEL, AFY, BEA, CHA, EDI, FAU, FER, GIS, LTA, LTL, MER, MFI, MOR, MTT, MWW, TAM and TON. In one preferred embodiment, the molecular sieve of the invention has an AEI topology or a CHA topology, or a combination thereof, most preferably a CHA topology.

Molecular sieve materials all have 3-dimensional, four-connected framework structure of corner-sharing $TO_4$ tetrahedra, where T is any tetrahedrally coordinated cation. These molecular sieves are typically described in terms of the size of the ring that defines a pore, where the size is based on the number of T atoms in the ring. Other framework-type characteristics include the arrangement of rings that form a cage, and when present, the dimension of channels, and the spaces between the cages. See van Bekkum, et al., *Introduction to Zeolite Science and Practice*, Second Completely Revised and Expanded Edition, Volume 137, pages 1-67, Elsevier Science, B. V., Amsterdam, Netherlands (2001).

Molecular sieves, particularly zeolitic and zeolitic-type molecular sieves, preferably have a molecular framework of one, preferably two or more corner-sharing $[TO_4]$ tetrahedral units, more preferably, two or more $[SiO_4]$, $[AlO_4]$ and/or $[PO_4]$ tetrahedral units, and most preferably $[SiO_4]$, $[AlO_4]$ and $[PO_4]$ tetrahedral units. These silicon, aluminum, and phosphorous based molecular sieves and metal containing silicon, aluminum and phosphorous based molecular sieves have been described in detail in numerous publications including for example, U.S. Pat. No. 4,567,029 (MeAPO where Me is Mg, Mn, Zn, or Co), U.S. Pat. No. 4,440,871 (SAPO), European Patent Application EP-A-0 159 624 (ELAPSO where El is As, Be, B, Cr, Co, Ga, Ge, Fe, Li, Mg, Mn, Ti or Zn), U.S. Pat. No. 4,554,143 (FeAPO), U.S. Pat. Nos. 4,822,478, 4,683,217, 4,744,885 (FeAPSO), EP-A-0 158 975 and U.S. Pat. No. 4,935,216 (ZnAPSO, EP-A-0 161 489 (CoAPSO), EP-A-0 158 976 (ELAPO, where EL is Co, Fe, Mg, Mn, Ti or Zn), U.S. Pat. No. 4,310,440 ($AlPO_4$), EP-A-0 158 350 (SENAPSO), U.S. Pat. No. 4,973,460 (LiAPSO), U.S. Pat. No. 4,789,535 (LiAPO), U.S. Pat. No. 4,992,250 (GeAPSO), U.S. Pat. No. 4,888,167 (GeAPO), U.S. Pat. No. 5,057,295 (BAPSO), U.S. Pat. No. 4,738,837 (CrAPSO), U.S. Pat. Nos. 4,759,919, and 4,851,106 (CrAPO), U.S. Pat. Nos. 4,758,419, 4,882,038, 5,434,326 and 5,478,787 (MgAPSO), U.S. Pat. No. 4,554,143 (FeAPO), U.S. Pat. No. 4,894,213 (AsAPSO), U.S. Pat. No. 4,913,888 (AsAPO), U.S. Pat. Nos. 4,686,092, 4,846,956 and 4,793,833 (MnAPSO), U.S. Pat. Nos. 5,345,011 and 6,156,931 (MnAPO), U.S. Pat. No. 4,737,353 (BeAPSO), U.S. Pat. No. 4,940,570 (BeAPO), U.S. Pat. Nos. 4,801,309, 4,684,617 and 4,880,520 (TiAPSO), U.S. Pat. Nos. 4,500,651, 4,551,236 and 4,605,492 (TiAPO), U.S. Pat. No. 4,824,554, 4,744,970 (CoAPSO), U.S. Pat. No. 4,735,806 (GaAPSO) EP-A-0 293 937 (QAPSO, where Q is framework oxide unit $[QO_2]$), as well as U.S. Pat. Nos. 4,567,029, 4,686,093, 4,781,814, 4,793,984, 4,801,364, 4,853,197, 4,917,876, 4,952,384, 4,956,164, 4,956,165, 4,973,785, 5,241,093, 5,493,066 and 5,675,050, all of which are herein fully incorporated by reference.

Other molecular sieves include those described in EP-0 888 187 B1 (microporous crystalline metallophosphates, $SAPO_4$ (UIO-6)), U.S. Pat. No. 6,004,898 (molecular sieve and an alkaline earth metal), U.S. Pat. No. 6,743,747 (integrated hydrocarbon co-catalyst), PCT WO 01/64340 published Sep. 7, 2001(thorium containing molecular sieve), and R. Szostak, Handbook of Molecular Sieves, Van Nostrand Reinhold, New York, N.Y. (1992), which are all herein fully incorporated by reference.

The more preferred silicon, aluminum and/or phosphorous containing molecular sieves, and aluminum, phosphorous, and optionally silicon, containing molecular sieves include aluminophosphate (ALPO) molecular sieves and silicoaluminophosphate (SAPO) molecular sieves and substituted, preferably metal substituted, ALPO and SAPO molecular sieves. The most preferred molecular sieves are SAPO molecular sieves, and metal substituted SAPO molecular sieves. In an embodiment, the metal is an alkali metal of Group IA of the Periodic Table of Elements, an alkaline earth metal of Group IIA of the Periodic Table of Elements, a rare earth metal of Group IIIB, including the Lanthanides: lanthanum, cerium, praseodymium, neodymium, samarium, europium, gadolinium, terbium, dysprosium, holmium, erbium, thulium, ytterbium and lutetium; and scandium or yttrium of the Periodic Table of Elements, a transition metal of Groups IVB, VB, VIB, VIIB, VIIIB, and IB of the Periodic Table of Elements, or mixtures of any of these metal species. In one preferred embodiment, the metal is selected from the group consisting of Co, Cr, Cu, Fe, Ga, Ge, Mg, Mn, Ni, Sn, Ti, Zn and Zr, and mixtures thereof. In another preferred embodiment, these metal atoms discussed above are inserted into the framework of a molecular sieve through a tetrahedral unit, such as $[MeO_2]$, and carry a net charge depending on the valence state of the metal substituent. For example, in one embodiment, when the metal substituent has a valence state of +2, +3, +4, +5, or +6, the net charge of the tetrahedral unit is between −2 and +2.

In one embodiment, the molecular sieve, as described in many of the U.S. patents mentioned above, is represented by the empirical formula, on an anhydrous basis:

$$mR:(M_xAl_yP_z)O_2$$

wherein R represents at least- one templating agent, preferably an organic templating agent; m is the number of moles of R per mole of $(M_xAl_yP_z)O_2$ and m has a value from 0 to 1, preferably 0 to 0.5, and most preferably from 0 to 0.3; x, y, and z represent the mole fraction of Al, P and M as tetrahedral oxides, where M is a metal selected from one of Group IA, IIA, IB, IIB, IVB, VB, VIB, VIIB, VIIIB and Lanthanide's of the Periodic Table of Elements, preferably M is selected from one of the group consisting of Co, Cr, Cu, Fe, Ga, Ge, Mg, Mn, Ni, Sn, Ti, Zn and Zr. In an embodiment, m is greater than or equal to 0.2, and x, y and z are greater than or equal to 0.01.

In another embodiment, m is greater than 0.1 to about 1, x is greater than 0 to about 0.25, y is in the range of from 0.4 to 0.5, and z is in the range of from 0.25 to 0.5, more preferably m is from 0.15 to 0.7, x is from 0.01 to 0.2, y is from 0.4 to 0.5, and z is from 0.3 to 0.5.

Non-limiting examples of SAPO and ALPO molecular sieves used in the invention include one or a combination of SAPO-5, SAPO-8, SAPO-11, SAPO-16, SAPO-17, SAPO-18, SAPO-20, SAPO-31, SAPO-34, SAPO-35, SAPO-36, SAPO-37, SAPO-40, SAPO-41, SAPO-42, SAPO-44 (U.S. Pat. No. 6,162,415), SAPO-47, SAPO-56, ALPO-5, ALPO-11, ALPO-18, ALPO-31, ALPO-34, ALPO-36, ALPO-37, ALPO-46, and metal containing molecular sieves thereof. The more preferred zeolite-type molecular sieves include one or a combination of SAPO-18, SAPO-34, SAPO-35, SAPO-44, SAPO-56, ALPO-18 and ALPO-34, even more preferably one or a combination of SAPO-18, SAPO-34, ALPO-34 and ALPO-18, and metal containing molecular sieves thereof, and most preferably one or a combination of SAPO-34 and ALPO-18, and metal containing molecular sieves thereof.

In an embodiment, the molecular sieve is an intergrowth material having two or more distinct phases of crystalline structures within one molecular sieve composition. In particular, intergrowth molecular sieves are described in the U.S. Patent Publication Number 2002/0165089 and PCT WO 98/15496, both of which are herein fully incorporated by reference. In another embodiment, the molecular sieve comprises at least one intergrown phase of AEI and CHA framework-types. For example, SAPO-18, ALPO-18 and RUW-18 have an AEI framework-type, and SAPO-34 has a CHA framework-type. In still another embodiment, the molecular sieves used in the invention are combined with one or more other molecular sieves.

The molecular sieves are made or formulated into catalysts by combining the synthesized molecular sieves with a binder and/or a matrix material to form a molecular sieve catalyst composition or a formulated molecular sieve catalyst composition. This formulated molecular sieve catalyst composition is formed into useful shape and sized particles by conventional techniques such as spray drying, pelletizing, extrusion, and the like.

One skilled in the art will also appreciate that the olefins produced by the oxygenate-to-olefin conversion reaction of the present invention can be polymerized to form polyolefins, particularly polyethylene and polypropylene. Processes for forming polyolefins from olefins are known in the art. Catalytic processes are desired. Particularly desired are metallocene, Ziegler/Natta and acid catalytic systems. See, for example, U.S. Pat. Nos. 3,258,455; 3,305,538; 3,364,190; 5,892,079; 4,659,685; 4,076,698; 3,645,992; 4,302,565; and 4,243,691, the catalyst and process descriptions of each being expressly incorporated herein by reference. In general, these methods involve contacting the olefin product with a polyolefin-forming catalyst at a pressure and temperature effective to form the polyolefin product.

VII. Proposed Comparative Results

To further investigate this inventive method, simulations of particle attrition within a methanol-to-olefin reactor were performed. The simulations modeled the behavior of solid particles passing through a 3-stage cyclone separator upon leaving a riser reactor and a 2-stage cyclone separator situated after a regenerator. The model assumed that all particle attrition and losses were due to the cyclones, with no particle attrition or losses inside of the reactor or regenerator. The model provides an expected behavior for a cyclone separators operating in a reactor.

The following tables refer to Cases A, B, and C and show particle removal and loss predictions based for the reactor design described above. Case A represents a base case design using a cyclone arrangement where the 3 reactor cyclone stages and the 2 regenerator cyclone stages have a relatively high cyclone inlet velocity, 60-70 ft/sec. In Case B the inlet velocity for the primary (first) cyclone stage connected to the reactor was reduced to ~40 ft/sec while the secondary and tertiary stages were kept at ~60 and ~70 ft/sec respectively. The regenerator cyclone stages were also maintained at an inlet velocity of 70 ft/sec. Note that the difference between Case A and Case B is the primary cyclone stage. In Case C, the velocities in the reactor cyclone stages were further reduced and staggered, with the primary stage at ~30 ft/sec, the secondary stage at ~40 ft/sec, and the tertiary stage at ~70 ft/sec. Also, in Case C the cyclone inlet velocities for the regenerator cyclone stages were ~45 ft/sec and the secondary cyclone at ~70 ft/sec. Tables 1 and 2 provide a full listing of the operating conditions for the cyclones in Cases A, B, and C. This includes a description of the cyclone geometry, loading, and inlet and outlet velocities for each cyclone stage. Note that "Loading in" refers to the density of catalyst particles in the input flow to a cyclone.

TABLE 1

| | Cyclone Dimensions | | |
|---|---|---|---|
| | Case A | Case B | Case C |
| Reactor Stage 1 | | | |
| Cyclone diameter, ft. | 6.1 | 7.5 | 8.7 |
| Height of cyclone inlet, ft. | 4.0 | 5.0 | 5.8 |
| Width of cyclone inlet, ft. | 1.7 | 2.1 | 2.4 |
| Height of cyclone barrel, ft. | 12.2 | 15.1 | 17.4 |
| Outlet pipe length into barrel, ft. | 3.4 | 4.2 | 4.8 |
| Outlet pipe diameter, ft. | 2.9 | 3.42 | 3.63 |
| Height of cyclone cone, ft. | 18.4 | 22.7 | 26.17 |
| Inlet velocity, ft/sec. (calc.) | 61 | 39 | 30 |
| Loading in, lb/cu. ft. | 1.7 | 1.7 | 1.7 |
| Outlet velocity, ft/sec. (calc.) | 63 | 45 | 40 |
| $A_O/A_I$ | 1.0 | 0.9 | 0.7 |
| Reactor Stage 2 | | | |
| Cyclone diameter, ft. | 6.1 | 6.1 | 7.5 |
| Height of cyclone inlet, ft. | 4.0 | 4.0 | 5.0 |
| Width of cyclone inlet, ft. | 1.7 | 1.7 | 2.1 |
| Height of cyclone barrel, ft. | 12.2 | 12.2 | 15.1 |
| Outlet pipe length into barrel, ft. | 3.4 | 3.4 | 4.2 |
| Height of cyclone cone, ft. | 18.4 | 18.4 | 22.7 |

TABLE 1-continued

| | Cyclone Dimensions | | |
|---|---|---|---|
| | Case A | Case B | Case C |
| Inlet velocity, ft/sec. (calc.) | 61 | 61 | 39 |
| Loading in. lb/cu. Ft. | 0.00094 | 0.00071 | 0.00057 |
| Outlet velocity, ft/sec. (calc.) | 72 | 72 | 45 |
| $A_O/A_I$ | 0.8 | 0.8 | 0.9 |
| Reactor Stage 3 | | | |
| Cyclone diameter, ft. | 5.7 | 5.7 | 5.7 |
| Height of cyclone inlet, ft. | 3.7 | 3.7 | 3.7 |
| Width of cyclone inlet, ft. | 1.6 | 1.6 | 1.6 |
| Height of cyclone barrel, ft. | 11.3 | 11.3 | 11.3 |
| Outlet pipe length into barrel, ft. | 3.1 | 3.1 | 3.1 |
| Outlet pipe diameter, ft. | 2.7 | 2.7 | 2.7 |
| Height of cyclone cone, ft. | 17.0 | 17.0 | 17.0 |
| Inlet velocity, ft/sec. (calc.) | 70 | 70 | 70 |
| Loading in. lb/cu. ft. | 0.00005 | 0.00003 | 0.00004 |
| Outlet velocity, ft/sec. (calc.) | 75 | 75 | 75 |
| $A_O/A_I$ | 0.9 | 0.9 | 0.9 |

TABLE 2

| | Cyclone Dimensions | | |
|---|---|---|---|
| | Case A | Case B | Case C |
| Regenerator Stage 1 | | | |
| Cyclone diameter, ft. | 3.9 | 3.9 | 4.6 |
| Height of cyclone inlet, ft. | 2.6 | 2.6 | 3.0 |
| Width of cyclone inlet, ft. | 1.1 | 1.1 | 1.3 |
| Height of cyclone barrel, ft. | 7.8 | 7.8 | 9.2 |
| Outlet pipe length into barrel, ft. | 2.2 | 2.2 | 2.5 |
| Outlet pipe diameter, ft. | 1.8 | 1.8 | 2 |
| Height of cyclone cone, ft. | 11.8 | 11.8 | 13.8 |
| Inlet velocity, ft/sec. (calc.) | 61 | 61 | 44 |
| Loading in. lb/cu. Ft. | 0.16850 | 0.15540 | 0.15350 |
| Outlet velocity, ft/sec. (calc.) | 68 | 68 | 55 |
| $A_O/A_I$ | 0.9 | 0.9 | 0.8 |
| Regenerator Stage 2 | | | |
| Cyclone diameter, ft. | 3.6 | 3.6 | 3.6 |
| Height of cyclone inlet, ft. | 2.4 | 2.4 | 2.4 |
| Width of cyclone inlet, ft. | 1.0 | 1.0 | 1.0 |
| Height of cyclone barrel, ft. | 7.3 | 7.3 | 7.3 |
| Outlet pipe length into barrel, ft. | 2.0 | 2.0 | 2.0 |
| Outlet pipe diameter, ft. | 1.6 | 1.6 | 1.6 |
| Height of cyclone cone, ft. | 10.9 | 10.9 | 10.9 |
| Inlet velocity, ft/sec. (calc.) | 72 | 72 | 72 |
| Loading in. lb/cu. Ft. | 0.00006 | 0.00005 | 0.00006 |
| Outlet velocity, ft/sec. (calc.) | 86 | 86 | 86 |
| $A_O/A_I$ | 0.8 | 0.8 | 0.8 |

Table 3 shows the predicted particle size distribution for particles within the reactor system for Cases A, B, and C during steady state operation of the reactor and regenerator cyclone stages. The particle size distribution represents the distribution present in an e-cat hopper or similar holding area. As solid particles pass out of the diplegs of the cyclone separators, the solid particles are eventually returned to a common holding area so that the particles can be introduced again into the reactor. A comparison of the cases shows that there are more small or fine particles present in Case A than Cases B or C. For example, the cumulative weight % of particles in Case A having a particle size of less than 44 microns (fines) is 8.4%. In other words, the total weight of all particles having a size of less than 44 microns is 8.4% of the total weight of all particles present in Case A. In Case B, this number is reduced to 6.7%, and in Case C the weight % of particles less than 44 microns is 4.9%. Table 3 shows that the methods of this invention result in an equilibrium particle distribution within a reactor that contains fewer fines or small particles.

TABLE 3

| Reactor E-Cat Particle Size Distribution | | | |
|---|---|---|---|
| Particle Size | Cumulative Wt % | | |
| (micron) | Case A | Case B | Case C |
| 0.5 | 0.000 | 0.000 | 0.000 |
| 5.05 | 0.000 | 0.000 | 0.000 |
| 9.55 | 0.000 | 0.000 | 0.000 |
| 20 | 0.061 | 0.036 | 0.020 |
| 40 | 4.7 | 3.6 | 2.3 |
| 44 | 8.4 | 6.7 | 4.9 |
| 60 | 29.2 | 25.8 | 24.5 |
| 80 | 56.1 | 52.9 | 53.0 |
| 100 | 75.8 | 73.9 | 74.1 |
| 120 | 87.3 | 86.3 | 86.4 |
| 140 | 93.7 | 93.2 | 93.2 |
| 160 | 97.0 | 96.8 | 96.8 |
| 180 | 98.8 | 98.7 | 98.7 |
| 200 | 99.7 | 99.7 | 99.7 |

The predicted results in Table 3 show that the invention allows a reactor to be operated with reduced amounts of fines in the reactor. As shown above, the invention can produce a cumulative weight of fines (such as cumulative weight of particles having a size of 44 microns or less) of 7% or less, or 6% or less, or 5% or less. In other embodiments, the invention can produce a cumulative weight of fines of 4% or less, or 3% or less, or 2% or less, based on total weight of solids in the reactor. In still another embodiment, the invention can produce a cumulative weight of particles less than 20 microns in size of 0.05% or less, or 0.04% or less, 0.03% or less, or 0.02% or less.

Table 4 shows the overall solids losses predicted for each of the cases. In each case, the weight of catalyst particles entering the initial separator is 49,226,381 lb/hr. As shown in Table 4, catalyst losses from the reactor are reduced in Cases B and C, where at least the first (primary) cyclone separator was operated at a lower inlet velocity according to the invention. The calculated overall solid loss rate for Case A was 339 lb/hr. The configuration in Case B produced a solids loss rate of 180 lb/hr, a reduction in solids losses by 47% compared to the Case A configuration. Case C further reduced solids (catalyst) losses by roughly 60% as compared with Case A. The estimated overall solids loss rate for Case C was 135 lb/hr. Table 4 demonstrates that by reducing the number of particles with a size under 44 μm (or alternatively the number under 50 μm, 40 μm, 30 μm, or 20 μm) as shown in Table 3, the invention reduces the amount of particle losses.

TABLE 4

| Solids (Catalyst) Losses, lb/hr | | | |
|---|---|---|---|
| | Case A | Case B | Case C |
| Reactor Losses | 317.6 | 160.9 | 123.2 |
| Regenerator Losses | 31.2 | 18.9 | 12.0 |
| Total | 338.8 | 179.8 | 135.2 |
| Losses relative to amount of catalyst entering initial separator | 0.0007 wt % | 0.0004 wt % | 0.0003 wt % |

As shown in Table 4, one way to characterize the loss of particles within the cyclone separators is in relation to the total weight of particles passing through the initial separation stage. By reducing the amount of fines present in a reaction system, the invention can provide a reduction in the amount of catalyst lost during operation of a reactor. In an embodiment, 0.0005 wt % or less of the particles entering an initial separator are lost from the reactor. In another embodiment, the invention allows solid particles to be retained so that 0.0004 wt % or less of the particles entering an initial separator are lost from the reactor. In still another embodiment, 0.0003 wt % or less of the particles entering an initial separator are lost from the reactor. In yet another embodiment, 0.0002 wt % or less of the particles entering an initial separator are lost from the reactor.

VIII. Quench System

In an embodiment where the reactor system is used for conversion of oxygenates (such as methanol) to olefins, recovery of fines can be further enhanced by use of an electrostatic precipitator or filter prior to condensation of the product olefin. In an oxygenate to olefin reaction, the product stream is composed primarily of water, olefins, and the oxygenate feedstock. Conventionally, water has the highest boiling point of these components.

Electrostatic precipitators can remove small particles from a gas stream with high efficiency. The restrictions on using electrostatic precipitators are that the temperature must be kept below 800° F. while avoiding condensation of liquid products in the precipitator.

At temperatures above 250° F., water will stay in the gas phase. As water is typically the highest boiling point component in the reactor effluent, this provides a temperature window in which an electrostatic precipitator can be operated. In this invention, the product output stream of an oxygenate-to-olefin reaction is cooled to about 250° F. to 800° F. Preferably the product output stream is cooled to below 500° F. The output stream is then passed through a precipitator or filter such as an electrostatic precipitator, a baghouse, or a ceramic, metallic, or fabric filter. This separates out any remaining particles in the output stream from the desired product gases. The output stream is then passed to a traditional quench system for separation of the desired output gases from any water contained in the output stream. A portion of the particles collected by the precipitator or filter may be returned to the reactor vessel for further processing. This invention allows the remaining solids to be collected in a dry state, thus avoiding the need to separate the particles from one or more liquids formed after quenching of the product output stream.

In an embodiment of this invention, after contacting the oxygenate feedstock with the oxygenate conversion catalyst, the oxygenate conversion reaction product is cooled to between about 250° F. and about 800° F. Preferably, the reaction product is cooled to between about 250° F. and about 500° F. The conversion reaction product is then passed through a precipitator or filter such as an electrostatic precipitator, a baghouse, or a ceramic, metallic, or fabric filter to remove solid particles from the product stream. The oxygenate conversion reaction product effluent comprising olefin products and water is then quenched by any suitable method, such as contacting a suitable quench medium in a quench tower without first going through a product fractionation step. Alternatively, the product effluent may be used to provide heat directly to the oxygenate feedstock. The temperature and the heat content of the product effluent are reduced to intermediate levels afterwards. The product effluent at this lower temperature and lower heat content is sent to the quench tower for direct quenching.

The compounds in the effluent stream which are gaseous under the quenching conditions are separated from the quench tower as a light product fraction for olefin product recovery and purification. The light product fraction conventionally comprises light olefins, dimethyl ether, methane, CO, $CO_2$, ethane, propane, and other minor components such as water and unreacted oxygenate feedstock. The compounds in the effluent stream which are liquid under quenching conditions, are separated from the quench tower as a heavy product fraction for heat recovery, and possible division into several fractions and separation of the quench medium. The heavy product fraction comprises byproduct water, a portion of the unreacted oxygenate feedstock (except those oxygenates that are gases under quenching conditions), a small portion of the oxygenate conversion byproducts, particularly heavy hydrocarbons (C5+), and usually the bulk of the quench medium.

Preferably, a quench medium is selected from a composition which remains substantially as a liquid under the quenching conditions, thus minimizing the amount of the quench medium present in the light gaseous product fraction which must undergo more expensive gaseous product processing steps to recover commercially acceptable grades of light olefin products. A preferred quench medium is selected from the group consisting of water and streams that are substantially water. More preferably, the quench medium is a stream which is substantially water and is selected from the several fractions of the heavy product fraction from the quench tower.

The amount of quench medium circulated in the quench tower at a particular temperature for product quenching should be not more than what is needed to produce a heavy product fraction exiting the quench tower having a temperature at least about 5° C. higher than the first temperature of the oxygenate feedstock from the storage tank. In another embodiment, as already discussed, the oxygenate conversion reactor effluent stream is used directly as a heat exchanger fluid to provide heat to the oxygenate feedstock before it enters the oxygenate conversion reactor to contact the oxygenate conversion catalyst.

In an embodiment, the pressure in the quench tower and the temperature of the heavy product fraction effluent are maintained at effective levels for recovery of the highest quantity and quality of process heat. More preferably, the difference between the heavy product fraction effluent pressure and the pressure at which the feedstock is vaporized is below about 700 kPa, more preferably below about 207 kPa. The temperature of the heavy product fraction effluent from the quench tower preferably is maintained at no less than about 30° C. below the bubble point of the heavy product fraction effluent. Maintaining a temperature differential between the heavy product fraction effluent and its bubble point provides the highest possible bottoms temperature in the quench tower and the most economically practical recovery of useful heat from the heavy product fraction effluent.

Preferably, the heavy product fraction effluent (heavy product fraction) from the quench tower is pressurized and used for providing heat to other streams. In one embodiment, the heavy product fraction, or any, or all of the several fractions into which the heavy product fraction is divided, or streams from quench medium separations thereof, are used directly as a heat exchanger fluid to increase the heat content and/or temperature of the oxygenate feedstock at one or more of the stages with successively higher heat contents. Further, any of the several fractions or streams produced from the quench medium separations thereof may be used to increase the heat contents of other streams within the overall oxygenate conversion reaction and product recovery process. The cooled quench medium recovered from such fractions and streams may be returned back to the quench tower.

In a preferred embodiment, particularly when the oxygenate conversion is not complete and the quench medium consists essentially of water, the heavy product fraction is divided into two fractions, a first fraction and a second fraction. The relative quantities of the first fraction and the second fraction depend on the overall amount of heat that needs to be removed from the product effluent stream in the quench operation, and the temperature of the quench medium introduced into the quench tower. The relative quantities are set to optimize equipment cost for heat recovery and utility consumptions. The first fraction is cooled to a desired temperature and sent back to the quench tower as a recycle, i.e. quench water. The utility required to cool the first fraction, e.g. cooling water, may be reduced by using the product effluent stream from the oxygenate conversion reactor as a heat exchange fluid to heat the oxygenate feedstock before the feedstock enters the oxygenate conversion reactor and/or before the product effluent stream enters the quench tower.

The second fraction of the heavy product fraction effluent is sent to a fractionator to separate the quench medium, which consists essentially of water—a part of it may originate as the recycled portion of the byproduct water from the oxygenate conversion reaction when the feedstock oxygenate has at least one oxygen—from other compounds, such as unreacted oxygenates or certain heavier hydrocarbons from the oxygenate conversion reaction, present in the fraction. If other streams having compositions similar to or compatible with the second fraction exist within the oxygenate conversion and the associated product recovery process, such other streams are combined with the second fraction first and the combined stream is sent to the fractionator.

Generally, it is desirable to fractionate a mixture into components as sharply as possible. In this invention, it is preferable for the overhead oxygenate fraction and/or the heavies-containing fraction from the fractionator to have a composition of water as introduced in the second fraction of the heavy product fraction in the range of from about 15 mol % to about 99.5 mol %, preferably from about 25 mol % to about 90 mol %. An increase in the water composition of the overhead fraction tends to increase the condensation temperature, and more heat can be recovered economically from the overhead fraction of the fractionator to improve heat integration for the entire process. Preferably, the recovered overhead oxygenate fraction contains at least about 90 mol % of the oxygenate contained in the second fraction of the heavy fraction. More preferably, the recovered overhead oxygenate fraction contains at least about 99 mol % of the oxygenate contained in the second fraction of the heavy fraction.

The overhead fraction of the fractionator is condensed in a heat exchanger, i.e. a condenser, against the oxygenate feedstock at one of the stages, from one to about three where the oxygenate feedstock is given successively higher heat contents. It is preferable for the overhead fraction of the fractionator to have a pressure at least about 69 kPa higher than the pressure of the oxygen feedstock in the condensor. This pressure differential also increases the condensation temperature of the overhead fraction, making heat recovery from the overhead fraction more economical.

The bottoms fraction of the fractionator consists essentially of byproduct water from the oxygenate conversion reaction. Preferably, this bottoms fraction is pressurized and used to heat the oxygenate feedstock at one of the stages, from one to about three, where the oxygenate feedstock is given successively higher heat contents prior to entering the oxygenate conversion reactor. The fractionator is operated such that the temperature of the bottoms fraction is at least about 5° C., preferably at least about 25° C., higher than the first temperature of the oxygenate feed from storage. The operating temperature inside of the fractionator is determined by a number of parameters, including, but not necessarily limited to the fractionator overhead pressure and the overall pressure drop inside of the fractionator.

Figure 5:
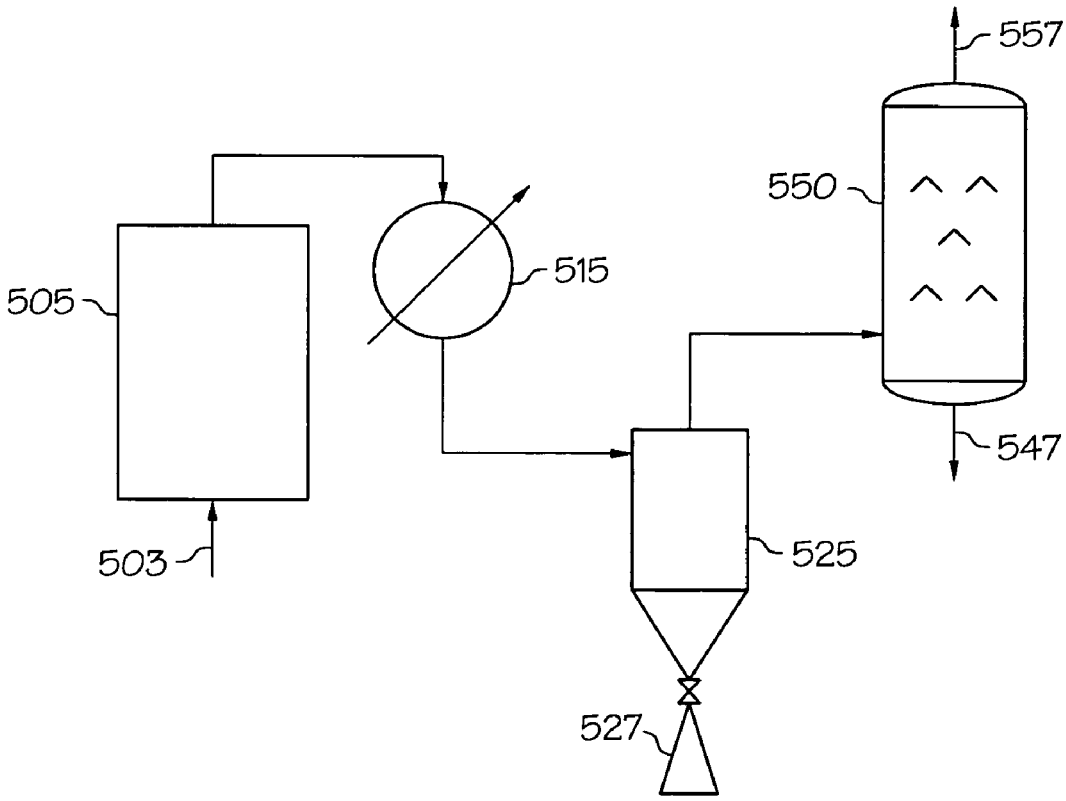
FIG. 5 schematically shows a quench system according to an embodiment of the invention.

FIG. 5 shows an example of a quench system according to the invention. Feedstock flow 503, which can include solid catalyst particles, is flowed into a methanol-to-olefin reactor 505. Reactor 505 produces an output stream that includes product olefins, water, and particles that were not separated out prior to leaving the reactor. This output stream is cooled by cooler 515 to a temperature between 250° F. and 800° F. The cooled output stream is then passed through baghouse, electrostatic precipitator, or other filter 525, which separates dry catalyst fines (particles) 527 from the output stream. The remainder of the stream is then passed to quench tower 550 of the quench system for separation of the desired olefin products 557 from any remaining solids 547 that were still in the stream.

Persons of ordinary skill in the art will recognize that many modifications may be made to the present invention without departing from the spirit and scope of the present invention. The embodiments described herein are meant to be illustrative only and should not be taken as limiting the invention, which is defined by the following claims.

What is claimed is:

1. A process for removing catalyst solids from a gas-solids flow in a methanol to olefin reactor, comprising:

a) passing a feedstock through a fluidized bed of solid catalyst particles to form an olefin product flow containing solid catalyst particles;

b) separating the olefin product flow into at least two flows, wherein one of the flows has a lower density than at least one other flow;

c) cooling the lower density flow to a temperature between about 250° F. and about 800° F.;

d) flowing the lower density flow through a precipitator or filter to thereby remove solid catalyst particles from said lower density flow without condensing liquid in said precipitator or filter; and e) quenching the lower density flow to cause water to condense out of the flow.

2. The process of claim 1, wherein the precipitator or filter is selected from the group consisting of an electrostatic precipitator, a ceramic filter, a metallic filter, and a baghouse filter.

3. The process of claim 1, wherein separating the olefin product flow into at least two flows comprises:

flowing an olefin product flow within a reactor into at least one initial separator to separate the olefin product flow into a first portion and a second portion, the olefm product flow having a separator inlet velocity of 40 ft/sec or less; and feeding the second portion into one or more additional cyclone separators at an inlet velocity greater than or equal to the inlet velocity of the initial separator to produce the at least two flows.

4. The process of claim 1, wherein a portion of catalyst solids removed by the precipitator or filter are recycled bacic to the reactor to control a fines content in a system equilibrium catalyst or solids inventory at less than 20% by weight.

5. The process of claim 1, wherein a portion of catalyst solids removed by the precipitator or filter are recycled back to the reactor to control a fines content in a system equilibrium catalyst or solids inventory at less than 10% by weight.

6. The process of claim 1, wherein a portion of catalyst solids removed by the precipitator or filter are recycled back to the reactor to control a fines content in a system equilibrium catalyst or solids inventory at less than 5% by weight.

7. The process of claim 1, wherein a portion of catalyst solids removed by the precipitator or filter are recycled back to the reactor to control a fines content in a system equilibrium catalyst or solids inventory at less than 2% by weight.

8. The process of claim 1, wherein the lower density flow is cooled to a temperature between about 250° F. arid about 500° F.

* * * * *